US006064962A

United States Patent [19]

Oshikiri et al.

[11] Patent Number: 6,064,962

[45] **Date of Patent: *May 16, 2000**

[54] FORMANT EMPHASIS METHOD AND FORMANT EMPHASIS FILTER DEVICE

[75] Inventors: Masahiro Oshikiri, Urayasu; Masami Akamine, Yokosuka; Kimio Miseki, Kawasaki; Akinobu Yamashita, Tokyo, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/713,356

[22] Filed: Sep. 13, 1996

[30] Foreign Application Priority Data

| | | | |
|---|---|---|---|
| Sep. 14, 1995 | [JP] | Japan | 7-236628 |
| Sep. 14, 1995 | [JP] | Japan | 7-237465 |
| Nov. 28, 1995 | [JP] | Japan | 7-308797 |

[51] Int. Cl.[7] ..... G10L 5/02

[52] U.S. Cl. ..... 704/262; 704/258

[58] Field of Search ..... 703/207–209, 703/214

[56] References Cited

U.S. PATENT DOCUMENTS

| | | | |
|---|---|---|---|
| 5,018,200 | 5/1991 | Ozawa | 395/2.31 |
| 5,027,405 | 6/1991 | Ozawa | 395/2.32 |
| 5,150,387 | 9/1992 | Yoshikawa et al. | 375/240 |
| 5,241,650 | 8/1993 | Gerson et al. . | |
| 5,307,441 | 4/1994 | Tzeng | 395/2.31 |
| 5,570,453 | 10/1996 | Gerson et al. | 395/2.28 |
| 5,659,661 | 8/1997 | Ozawa | 395/2.37 |

FOREIGN PATENT DOCUMENTS

| | | |
|---|---|---|
| 0 294 020 | 12/1988 | European Pat. Off. . |
| 0 465 057 | 1/1992 | European Pat. Off. . |
| 64-13200 | 1/1989 | Japan . |
| 2-82710 | 3/1990 | Japan . |

OTHER PUBLICATIONS

Myung H. Sunwoo, et al., IEEE Transactions on Consumer Electronics, vol. 37, No. 4, pp. 772–782, Nov. 1, 1991, "Real–Time Implementation of the VSELP on a 16–Bit DSP Chip".

Vladimir Cuperman, et al., Speech Communication, vol. 12, No. 2, pp. 193–204, Jun. 01, 1993, "Low Delay Speech Coding".

"Quantization Procedures For The Excitation In Celp Coders," Peter Kroon, et al. Proc. ICASSP; Apr. 1987, pp. 1649–1652.

*Primary Examiner*—David R. Hudspeth
*Assistant Examiner*—Michael N. Opsasnick
*Attorney, Agent, or Firm*—Oblon, Spivak, McClelland, Maier & Neustadt, P.C.

[57] ABSTRACT

In a formant emphasis method of emphasizing the formant as the spectral peak of an input speech signal and attenuating the spectral valley of the input speech signal, a spectrum emphasis filter performs processing for emphasizing the formant of the input speech signal and attenuating the valley of the input speech signal. A first-order variable characteristic filter whose characteristic adaptively changes in accordance with the characteristic of the input speech signal and a first-order fixed characteristic filter compensate a spectral tilt included in an output signal from the spectrum emphasis filter.

18 Claims, 29 Drawing Sheets

FORMANT EMPHASIS METHOD AND FORMANT EMPHASIS FILTER DEVICE

BACKGROUND OF THE INVENTION

1. Field of the Invention

The present invention relates to a formant emphasis method of emphasizing the spectral peak (formant) of an input speech signal and attenuating the spectral valley of the input speech signal in a decoder in speech coding/decoding or a preprocessor in speech processing.

2. Description of the Related Art

A technique for highly efficiently coding a speech signal at a low bit rate is an important technique for efficient utilization of radio waves and a reduction in communication cost in mobile communications (e.g., an automobile telephone) and local area networks. A CELP (Code Excited Linear Prediction) scheme is known as a speech coding method capable of performing high-quality speech synthesis at a bit rate of 8 kbps or less. This CELP scheme was introduced by M. R. Schroeder and B. S. Atal, AT & T Bell Lab. in "Code-Excited Linear Prediction (CELP) High-Quality Speech at Very Low Bit Rates", Proc., ICASSP; 1985, pp. 937–939" (Reference 1) and has received a great deal of attention as a technique capable of synthesizing high-quality speech. A variety of examinations have been made for improvements in quality and a reduction in computation quantity. The quality degradation of synthesized speech is perceived at a very low bit rate of 8 kbps or less, and the quality is not yet satisfactory.

Under these circumstances, a technique for performing post-processing for emphasizing the spectral peak (formant) of synthesized speed and attenuating the spectral valley to improve subjective quality was reported by P. Kroon and B. S Atal, AT & T Bell Lab. in "Quantization Procedures for the Excitation in CELP Coders", Proc. ICASSP; 1987, pp. 1,649–1,652 (Reference 2). In Reference 2, an all-pole filter for multiplying a coefficient with an LPC coefficient (Linear Prediction Coding coefficient) sent from a decoder so as to moderate a spectrum envelope is used in post-processing to improve quality. This all-pole filter is expressed in a z transform domain defined by equation (1):

$$Q_1(z) = \frac{1}{A(z/\beta)} \tag{1}$$

wherein A(z/β) is expressed by equation (2) below:

$$A(z/\beta) = 1 - \sum_{i=1}^{P} \beta^i \alpha_i z^{-1} \tag{2}$$

($\alpha_i$: LPC coefficient, P: filter order, $0<\beta<1$)

An excessive spectral tilt is included in the synthesized speech in this all-pole filter Q1(z), and the synthesized sound becomes unclear. A formant emphasis filter which solves this problem is disclosed in Jpn. Pat. Appln. KOKAI Publication No. 64-13200 entitled "Improvement in Method of Compressing Digitally Coded Speech" (Reference 3). Reference 3 proposes a scheme for cascade-connecting a zero-pole filter arranged in consideration of spectral tilt compensation and a first-order bypass filter having fixed characteristics. A transfer function Q2(z) of this formant emphasis filter is expressed in z transform domain defined by equation (3) as follows:

$$Q_2(z) = \frac{A(z/\gamma)}{A(z/\beta)} \cdot (1 - \mu z^{-1}) \tag{3}$$

$$(0 < \gamma < \beta < 1, 0 < \mu < 1)$$

According to this formant emphasis filter, terms A(z/β) and $(1-\mu z^{-1})$ act to compensate the excessive spectral tilt of term A(z/β), so that the problem on the unclear synthesized sound can be solved. The filter order of the formant emphasis filter becomes the (2P+1)th order, and the processing quantity undesirably increases.

Another formant emphasis filter is disclosed in Jpn. Pat. Appln. KOKAI Publication No. 2-82710 entitled "Post-Processing Filter" (Reference 4). In Reference 4, a zero-pole filter in which a spectral tilt compensation item having a lower filter order is given as a numerator term. A transfer function Q3(z) of this formant emphasis filter is expressed in a z transform domain defined by equation (4) as follows:

$$Q_3(z) = \frac{A^{(M)}(z/\beta)}{A^{(P)}(z/\beta)} \tag{4}$$

(M and P: filter orders (M<P), $0<\beta<1$)

Numerator term $A^{(M)}(z/\beta)$ of equation (4) acts to compensate the spectral tilt. In this case, the processing quantity becomes small with a lower order M. The order M must be increased to some extent to sufficiently compensate the spectral tilt. If M=1, the formant emphasis filter still produces unclear synthesized speech.

The common problem of equations (3) and (4) is control of the filter coefficient of the formant emphasis filter by the fixed values β and γ or only the fixed value β. The filter characteristics of the formant emphasis filter cannot be finely adjusted, and the sound quality improvement capability of the formant emphasis filter has limitations. In addition, since the fixed values β and γ are used to always control the formant emphasis filter, adaptive processing in which formant emphasis is performed at a given portion of input speech and another portion thereof is attenuated cannot be performed.

As described above, in the conventional formant emphasis filter described above, the synthesized speech becomes unclear in the all-pole filter defined by equation (1), and subjective quality is degraded. When the zero-pole filter is cascade-connected to the first-order bypass filter, as defined in equation (3), although unclearness of the synthesized sound is solved to improve the subjective quality, the processing quality undesirably increases. In the zero-pole filter defined in equation (4), when the processing quantity is decreased by setting the order M=1 of the numerator term, the spectral tilt cannot be sufficiently compensated, and unclearness of the synthesized sound is left unsolved.

Since the filter coefficient of each conventional formant emphasis filter is controlled by the fixed values β and γ or only the fixed value γ, the following problems are posed. That is, the filter cannot be finely adjusted, and the sound quality improvement capability of the formant emphasis filter has limitations. In addition, since the formant emphasis filter is always controlled using the fixed values β and γ, adaptive processing in which formant emphasis is performed at a given portion of input speech and another portion thereof is attenuated cannot be performed.

Also, in a prior post filter, when the pitch period between the pitch harmonic peaks for voiced speech largely varies or is erroneously detected as double pitch or half pitch, the pitch harmonics of the decoded speech is turbulent. At this time, the pitch emphasis filter enhances the turbulence, so that the speech quality is extremely degraded.

SUMMARY OF THE INVENTION

It is an object of the present invention to provide a formant emphasis method and a formant emphasis filter, capable of obtaining high-quality speech.

More specifically, the above object is to provide a formant emphasis method and a formant emphasis filter, capable of obtained high-quality speech whose unclearness can be reduced with a small processing quantity.

It is another object of the present invention to provide a formant emphasis method and a formant emphasis filter, capable of finely controlling the filter coefficient of a formant emphasis filter to obtain higher-quality speech.

According to the first aspect of the present invention, there is provided a formant emphasis method comprising: performing formant emphasis processing for emphasizing a spectrum formant of an input speech signal and attenuating a spectrum valley of the input speech signal; and compensating a spectral tilt, caused by the formant emphasis processing, in accordance with a first-order filter whose characteristics adaptively change in accordance with characteristics of the input speech signal or spectrum emphasis characteristics and a first-order filter whose characteristics are fixed.

According to the second aspect of the present invention, there is provided a formant emphasis filter comprising a main filter for performing formant emphasis processing for emphasizing a spectrum formant of an input speech signal and attenuating a spectral valley of the input speech signal, and first and second tilt compensation filters cascade-connected to compensate a spectral tilt caused by formant emphasis by the main filter, wherein the first spectral tilt compensation filter is a first-order filter whose characteristics adaptively change in accordance with characteristics of the input speech signal or characteristics of the spectrum emphasis filter, and the second spectral tilt compensation filter is a first-order filter whose characteristics are fixed.

According to the formant emphasis method and filter according to the first and second aspects of the present invention, to compensate the excessive spectral tilt generated in the main filter for emphasizing the spectral formant of the input speech signal and attenuating the spectral valley of the input speech signal, the first spectral tilt compensation filter comprising the first-order filter whose filter characteristics adaptively change in accordance with the characteristics of the input speech signal or the characteristics of the main filter coarsely compensates the spectral tilt. Since the order of the first spectral tilt compensate filter is the first order, spectral tilt compensation can be realized with a slight increase in processing quantity. The speech signal is then filtered through the second spectral tilt compensation filter consisting of the first-order filter having the fixed characteristics to compensate the excessive spectral tilt which cannot be removed by the first spectral tilt compensation filter. Since the second spectral tilt compensation filter also has the first order, compensation can be performed without greatly increasing the processing quantity.

For example, the formant emphasis filter defined by equation (3) requires a sum total (2P+1) times, while the total sum of formant emphasis processing according to the present invention can be performed (P+2) times, thereby almost halving the processing quantity.

The excessive spectral tilt included in the main filter for emphasizing the spectral formant of the input speech signal and attenuating the spectral valley of the input speech signal represents simple spectral characteristics realized by first-order filters. For this reason, the excessive spectral tilt can be sufficiently and effectively compensated by the first-order variable characteristic filter and the first-order fixed characteristic filter. For example, in conventional spectral tilt compensation expressed by equation (3), compensation can be performed with a higher precision because the filter order is high. However, since the spectral characteristics of the excessive spectral tilt included in the main filter are simple, they can be sufficiently compensated by a cascade connection of the first-order variable characteristic filter and the first-order fixed characteristic filter. No auditory difference can be found between the present invention and the conventional method. In the formant emphasis filter defined by equation (4), when the order M=1 of the numerator term is given, the number of times of the sum total is almost equal to that of the present invention, but the effect of spectral tilt compensation cannot be sufficiently enhanced. To the contrary, since the first-order filter having variable characteristics is cascade-connected to the first-order filter having the fixed characteristics, the spectral tilt can be sufficiently and effectively compensated.

According to the formant emphasis method and filter according to the first and second aspects, the main filter, the first-order tilt compensation filter having the variable characteristics, and the first-order spectral tilt compensation filter having the fixed characteristics constitute the formant emphasis filter. Therefore, formant emphasis processing free from unclear sounds with a small processing quantity can be performed to effectively improve the subjective quality.

According to the third aspect, there is provided a formant emphasis method comprising: causing a pole filter to perform formant emphasis processing for emphasizing a spectral formant of an input speech signal and attenuating a spectral valley of the input speech signal; causing a zero filter to perform processing for compensating a spectral tilt caused by the formant emphasis processing; and determining at least one of filter coefficients of the pole filter and the zero filter in accordance with products of coefficients of each order of LPC coefficients of the input speech signal and constants arbitrarily predetermined in correspondence with the coefficients of each order.

According to the fourth aspect, there is provided a formant emphasis filter comprising a filter circuit constituted by cascade-connecting a pole filter for performing formant emphasis processing for emphasizing a spectral formant of an input speech signal and attenuating a spectral valley of the input speech signal and a zero filter for compensating a spectral tilt generated in the formant emphasis processing by the pole filter, and a filter coefficient determination circuit for determining the filter coefficients of the pole filter and the zero filter, wherein the filter coefficient determination circuit has a constant storage circuit for storing a plurality of constants arbitrarily predetermined in correspondence with coefficients of each order of LPC coefficients, and at least one of the filter coefficients of the pole and zero filters is determined by products of the coefficients of each order of the LPC filters of the input speech signal and corresponding constants stored in the constant storage circuit.

According to the formant emphasis method and filter according to the third and fourth aspects, since the filter coefficients are determined in accordance with the products of the LPC coefficients of the input speech signal and the plurality of constants arbitrarily predetermined in correspondence with the coefficients of each order of the LPC coefficients, the characteristics of the formant emphasis filter can be freely determined in accordance with setting of the plurality of constants.

The conventional formant emphasis filter comprises the pole filter having a transfer function of $1/A(z/\beta)$ shown in equation (3) and a zero filter having a transfer function of $A(z/\beta)$ shown in equation (3). The degree of formant emphasis is determined by the magnitudes of the values $\beta$ and $\gamma$. However, as can be apparent from equation (2), the filter coefficient of the pole filter is expressed in $\{\alpha_i\beta^i$: i=1 to P), and similarly the filter coefficient of the zero filter is expressed in $\{\alpha_i\gamma^i$: i=1 to P). Therefore, the coefficients to be multiplied with the LPC coefficients $\alpha_i$ (i=1 to P) to determine the respective filter coefficients are limited to have only exponential function values $\beta^i$ (i=1 to P) and $\gamma^i$ (i=1 to P) of the values $\beta$ and $\gamma$.

The formant emphasis filter aims at improving subjective quality. Whether the quality of speech is subjectively improved is generally determined by repeatedly performing listening of reproduced speech signal samples and parameter adjustment. For this reason, the coefficients to be multiplied with the LPC coefficients to obtain the filter coefficients as in the conventional example are not limited to the exponential function values, but are arbitrarily set as in the present invention, thus advantageously improving the speech quality by the formant emphasis filter.

According to a formant emphasis method according to another embodiment of the third aspect, different types of constant storage circuits for storing a plurality of constants arbitrarily predetermined in correspondence with coefficients of each order of LPC coefficients are arranged, and at least one of filter coefficients of a pole filter and a zero filter is determined by products of the coefficients of each order of the LPC coefficients of the input speech signal and corresponding constants stored in one of the different types of constant storage circuits on the basis of an attribute of the input speech signal.

A speech signal originally includes a domain in which a strong formant appears as in a vowel object, and quality can be improved by emphasizing the strong formant, and a region in which a formant does not clearly appear as in a consonant object, and a better result can be obtained by attenuating the unclear formant. A final subjective quality can be obtained by adaptively changing the degrees of emphasis in accordance with the attributes of the input speech signal. Formant emphasis is decreased in a background object where no speech is present, e.g., in a noise signal represented by engine noise, air-conditioning noise, and the like. Formant emphasis is increased in a domain where speech is present, thereby obtaining a better effect.

According to the third aspect, memory tables serving as different types of constant storage circuits for storing a plurality of constants arbitrarily predetermined in correspondence with the coefficients of each order of the LPC coefficients are prepared so as to differentiate the degrees of formant emphasis stepwise. A proper memory table is adaptively selected in accordance with the attributes such as a vowel object, consonant object, and background object of the input speech signal. Therefore, the memory table most suitable for the attribute of the input speech signal can always be selected, and speech quality upon formant emphasis can be finally improved.

According to the fifth aspect of the invention, there is provided a pitch emphasis device comprising a pitch emphasis circuit for pitch-emphasizing an input speech signal, and a control circuit for detecting a time change in at least one of a pitch period and a pitch gain of the speech signal and controlling a degree of pitch emphasis in the pitch emphasis means on the basis of the change.

In a case of the pitch emphasis device according to the fifth aspect, when the pitch period varies over a predetermined extend, the pitch emphasis filter coefficient is changed so that the degree of pitch emphasis is decreased or the pitch emphasis is stopped. Accordingly, the turbulence of the pitch harmonics is suppressed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
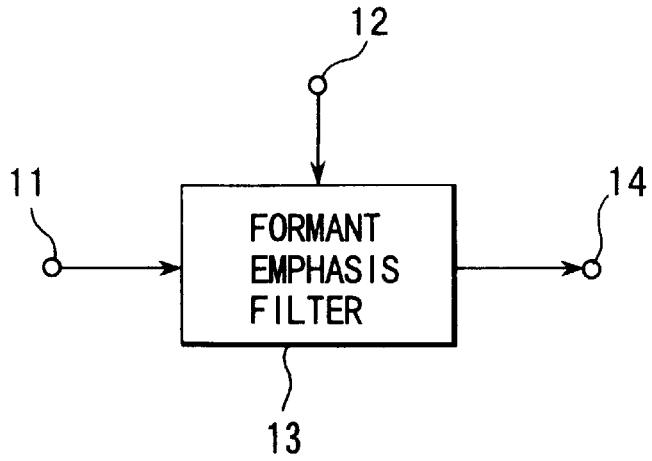
FIG. 1 is a block diagram for explaining the basic operation of a formant emphasis filter according to the first embodiment.

FIG. 1 is a block diagram for explaining the basic operation of a formant emphasis filter according to the first embodiment. Referring to FIG. 1, digitally processed speech signals are sequentially input from an input terminal 11 to a formant emphasis filter 13 in units of frames each consisting of a plurality of samples. In this embodiment, 40 samples constitute one frame. LPC coefficients representing the spectrum envelope of the speech signal in each frame are input from an input terminal 12 to a formant emphasis filter 13. The formant emphasis filter 13 emphasizes the formant of the speech signal input from the input terminal 11 using the LPC coefficients input from the input terminal 12 and outputs the resultant output signal to an output terminal 14.

Figure 2:
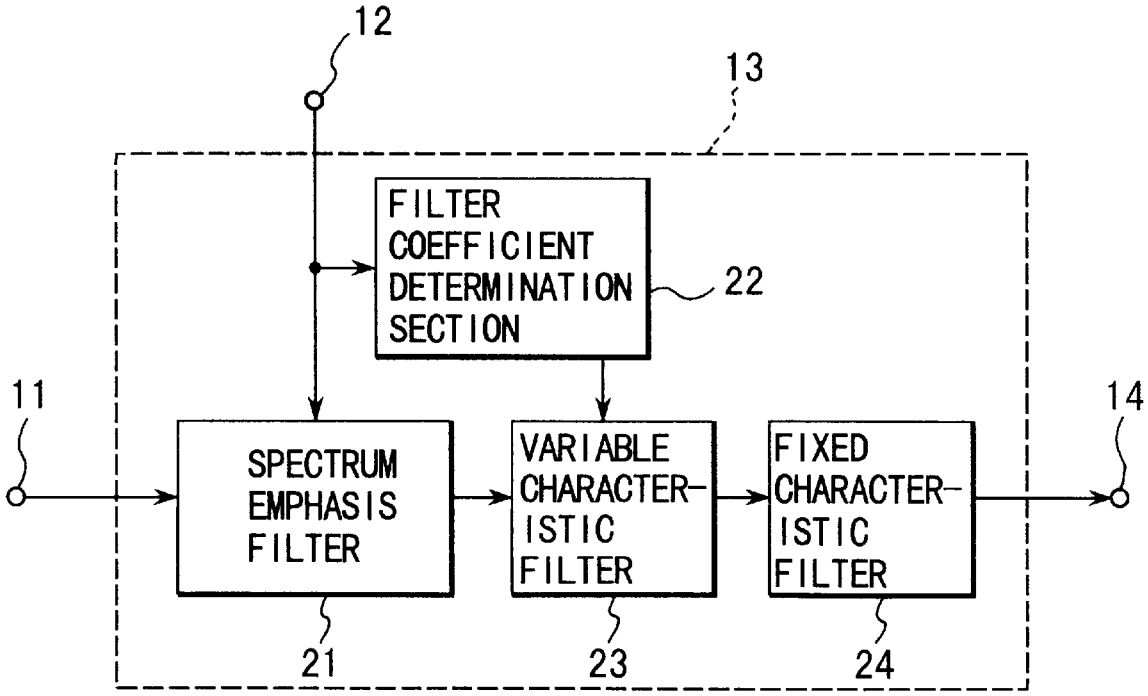
FIG. 2 is a block diagram of the formant emphasis filter according to the first embodiment.

FIG. 2 is a block diagram showing the internal arrangement of the formant emphasis filter 13 shown in FIG. 1. The formant emphasis filter 13 shown in FIG. 2 comprises a spectrum emphasis filter 21, a variable characteristic filter 23 whose characteristics are controlled by a filter coefficient determination section 22, and a fixed characteristic filter 24. The filters 21, 23, and 24 are cascade-connected to each other.

The spectrum emphasis filter 21 serves as a main filter for achieving the basic operation of the formant emphasis filter 13 such that the spectral formant of the input speech signal is emphasized and the spectral valley of the input signal is attenuated. The spectrum emphasis filter 21 performs formant emphasis processing of the speech signal on the basis of the LPC coefficients obtained from the input terminal 12. The spectrum emphasis filter 21 can be expressed in a z transform domain defined by equation (5) using LPC coefficients $\alpha_i$ (i=1 to P) as follows:

$$E(z) = \frac{1}{1 - \sum_{i=1}^{P} \alpha_i \beta^i z^{-i}} C(t) \tag{5}$$

where C(z) is the z transform notation of the input speech signal, E(z) is the z transform notation of the output signal, P is the filter order (P=10 in this embodiment), and β is a constant (0<β<1) representing the degree of spectrum emphasis. The degree of spectrum emphasis is increased as the constant β comes close to 1, and the noise suppression effect is enhanced, but unclearness of the synthesized sound is undesirably increased. The degree of spectrum intensity becomes small as the constant β comes closer to 0, thereby reducing the noise suppression effect.

Equation (5) can be expressed in a time region as follows:

$$e(n) = c(n) + \sum_{i=1}^{P} \alpha_i \beta^i e(n-i) \tag{6}$$

where c(n) is the time domain signal of C(z), and e(n) is the time domain signal of E(z).

A filter coefficient $\mu_1$ is obtained by the filter coefficient determination section 22 on the basis of the LPC coefficients input from the input terminal 12. The coefficient $\mu_1$ is determined to compensate the spectral tilt present in an all-pole filter defined by the LPC coefficients. When the all-pole filter defined by the LPC coefficients has low-pass characteristics, the coefficient $\mu_1$ has a negative value. When the all-pole filter defined by the LPC coefficients has high-pass characteristics, the coefficient $\mu_1$ has a positive value. A method of determining the coefficient $\mu_1$ will be described later in detail.

The output signal e(n) from the spectrum emphasis filter and the output $\mu_1$ from the filter coefficient determination section 22 are input to the variable characteristic filter 23. The order of the variable characteristic filter 23 is the first order. An output signal F(z) from the variable characteristic filter 23 is expressed in a z transform domain defined by equation (7):

$$F(z)=(1+\mu_1 z^{-1})E(z) \tag{7}$$

Equation (7) is expressed in a time region as equation (8):

$$f(n)=e(n)+\mu_1 e(n-1) \tag{8}$$

where e(n) is the time region signal of E(z), and f(n) is the time region signal of F(z).

As can be apparent from equation (8), when the all-pole filter defined by the LPC coefficients has high-pass characteristics, the coefficient $\mu_1$ has a positive value, so that the filter 23 serves as a low-pass filter to compensate the high-pass characteristics of the all-pole filter defined by the LPC coefficients. To the contrary, when the all-pole filter defined by the LPC coefficients has low-pass characteristics, the coefficient $\mu_1$ has a negative value, so that the filter 23 serves as a high-pass filter to compensate the low-pass characteristics of the all-pole filter defined by the LPC coefficients.

The output f(n) from the variable characteristic filter 23 is input to the fixed characteristic filter 24. The order of the fixed characteristic filter 24 is the first order. An output signal G(z) from the variable characteristic filter 23 is expressed in a z transform domain defined by equation (9):

$$G(z)=(1-\mu_2 z^{-1})F(z) \tag{9}$$

Equation (9) can be expressed in a time region as equation (10).

$$g(n)=f(n)-\mu_2 f(n-1) \tag{10}$$

where f(n) is the time region signal of F(z), and g(n) is the time region signal of G(z).

Since $\mu_2$ is a fixed positive value, the fixed characteristic filter 24 always has high-pass characteristics in accordance with equation (9). The filter characteristics of the spectrum emphasis filter 21 usually serve as the low-pass characteristics in the speech interval which has an auditory importance. To correct these characteristics, the variable characteristic filter 23 serves as a high-pass filter. In many cases, the low-pass characteristics cannot be perfectly corrected, and unclearness of the speech sound is left. To remove this, the fixed characteristic filter 24 having high-pass characteristics is prepared. The resultant output signal g(n) is output from the output terminal 14.

Figure 3:
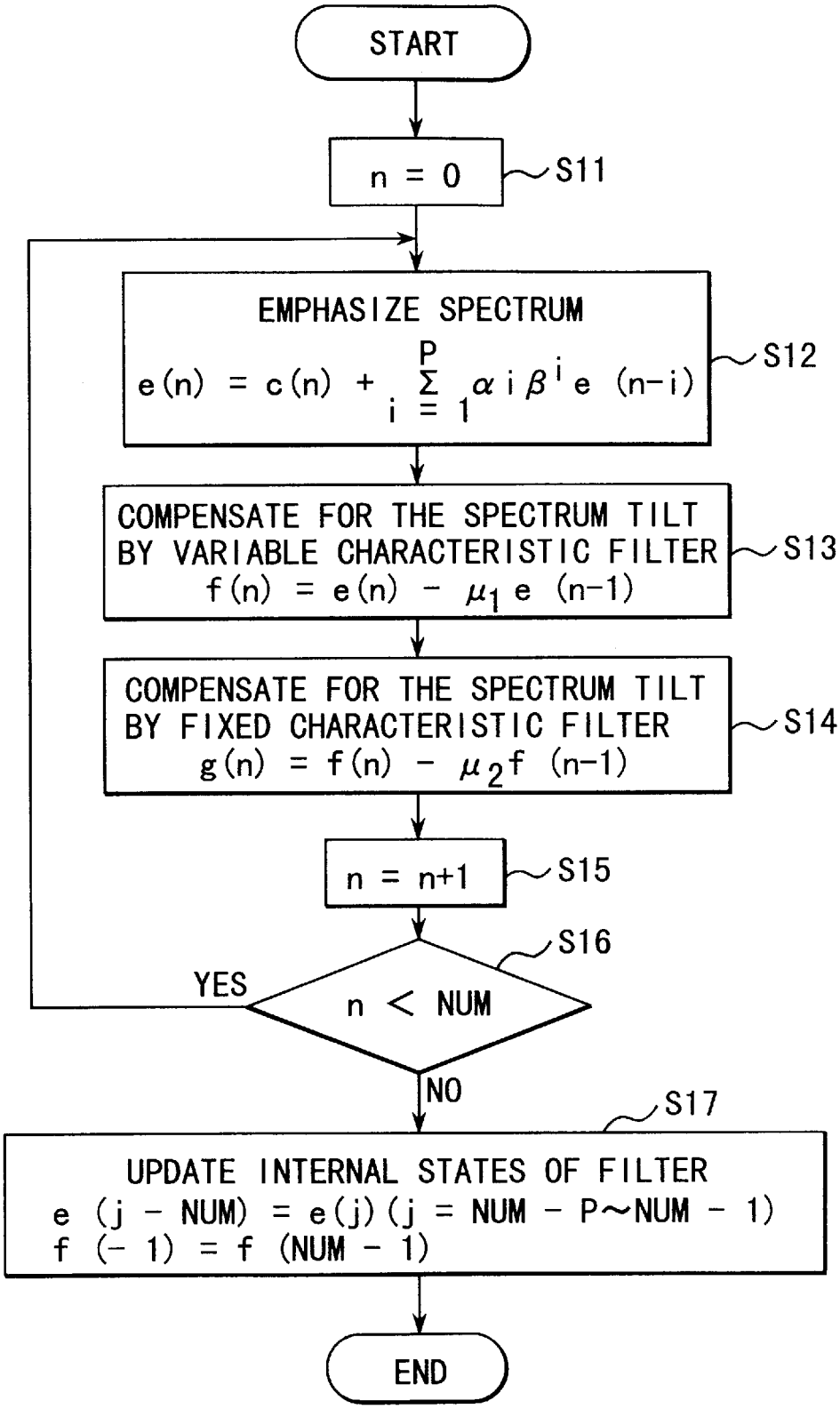
FIG. 3 is a flow chart showing a processing sequence of the formant emphasis filter of the first embodiment.

The above processing flow is summarized in the flow chart in FIG. 3. {c(n), n=0 to NUM−1} is the digitally processed input speech signal and represents signals sequentially input from the input terminal 11. {e(n), n=−P to NUM−1} and {f(n), n=−1 to NUM−1} represent the internal states of the filter. {g(n), n=0 to NUM−1} is the output speech signal, and output signals are sequentially output from the output terminal 14. A variable n of e(n) and f(n) which has a negative value represents use of the internal states of the previous frame. In the above expressions, NUM represents a frame length (NUM=40 in this case), and P represents the order of the spectrum emphasis filter (P=10 in this case).

The variable n is cleared to zero in step S11. In step S12, a speech signal is subjected to spectrum emphasis processing to obtain e(n). In step S13, the spectrum tilt of the spectrum emphasis signal e(n) is almost compensated by the variable characteristic filter to obtain f(n). The remaining spectrum tilt of the signal f(n) is compensated by the fixed characteristic filter to obtain g(n) in step S14. The output signal g(n) is output from the output terminal 14. In step S15, the variable n is incremented by one. In step S16, n is compared with NUM. If the variable n is smaller than NUM, the flow returns to step S12. However, if the variable n is equal to or larger than NUM, the flow advances to step S17. In step S17, the internal states of the filter are updated for the next frame to prepare for the input speech signal of the next frame, and processing is ended.

In the above processing, the order of steps S12, S13, and S14 is not predetermined. When the order is changed, the allocation of the internal states (rearrangement of the filters 21, 23, and 24) of the formant emphasis filter 12 must be performed so as to match the changed order, as a matter of course.

Figure 4:
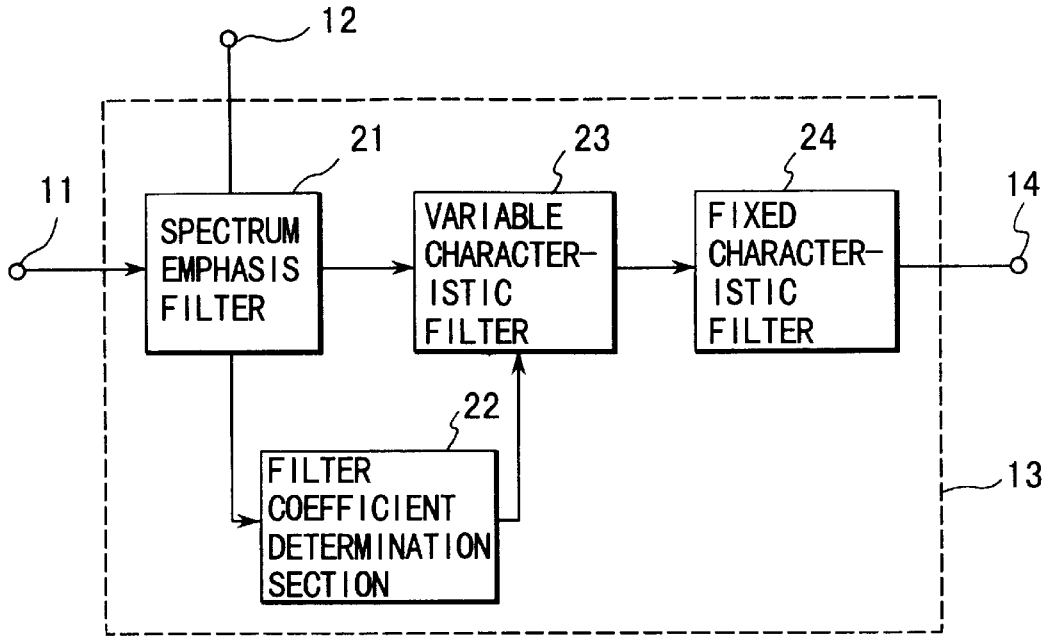
FIG. 4 is a block diagram of a formant emphasis filter according to the second embodiment.

FIG. 4 is a block diagram showing the arrangement of the second embodiment. The same reference numerals as in FIG. 2 denote the same parts in FIG. 4, and a detailed description thereof will be omitted. The second embodiment is different from the first embodiment in inputs to a filter coefficient determination section 22.

That is, inputs to the filter coefficient determination section 22 in the second embodiment are weighted LPC coefficients $\alpha_i\beta^i$ (i=1 to P) used in a spectrum emphasis filter 21. Since the weighted LPC coefficients are the filter coefficients used in the spectrum emphasis filter 21, the filter characteristics actually used in spectrum emphasis can be accurately obtained. In this embodiment, a filter coefficient $\mu_1$ of a variable characteristic filter 23 is obtained on the basis of the weighted LPC coefficients, so that more accurate spectral tilt compensation can be performed.

Figure 5:
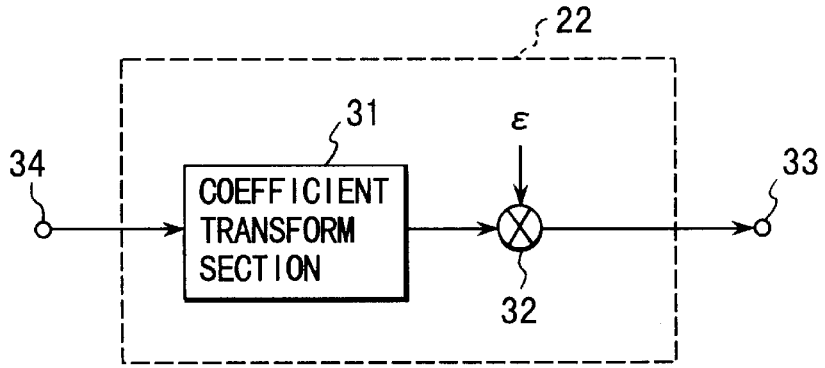
FIG. 5 is a block diagram showing an arrangement of a filter coefficient determination section according to the first and second embodiments.

FIG. 5 is a block diagram showing an arrangement of the filter coefficient determination section 22. LPC coefficients $\alpha_i$ (i=1 to P) or the weighted LPC coefficients $\alpha_i\beta^i$ (i=1 to P) are input from an input terminal 34. A coefficient transform section 31 for transforming the LPC coefficients into PARCOR coefficients (partial autocorrelation coefficients) transforms the input LPC coefficients or the input weighted LPC coefficients into PARCOR coefficients. The detailed method is described by Furui in "Digital Speech Processing", Tokai University Press (Reference 5), and a detailed description thereof will be omitted. The coefficient transform section 31 outputs a first-order PARCOR coefficient k1.

The following facts are known as the nature unique to the PARCOR coefficient. That is, a filter spectrum constituted by LPC coefficients input to the coefficient transform section 31 has low-pass characteristics, the first-order PARCOR coefficient has a negative value. When the low-pass characteristics are enhanced, the first-order PARCOR coefficient comes close to −1. To the contrary, when the spectrum has high-pass characteristics, the first-order PARCOR coefficient has a positive value. When the high-pass characteristics are enhanced, the first-order PARCOR coefficient comes close to +1. When the filter characteristics of the variable characteristic filter 23 defined by equation (7) are controlled using the first-order PARCOR coefficients, the LPC coefficient input to the coefficient transform section 31, i.e., the excessive spectral tilt included in the spectrum envelope of the spectrum emphasis filter 21 can be efficiently compensated. More specifically, a result obtained by multiplying a positive constant $\epsilon$ with the first-order PARCOR coefficient k1 from the coefficient transform section 31 by a multiplier 32 is output from an output terminal 33 as $\mu_1$:

$$\mu_1=k_1\epsilon \tag{11}$$

Figure 6:
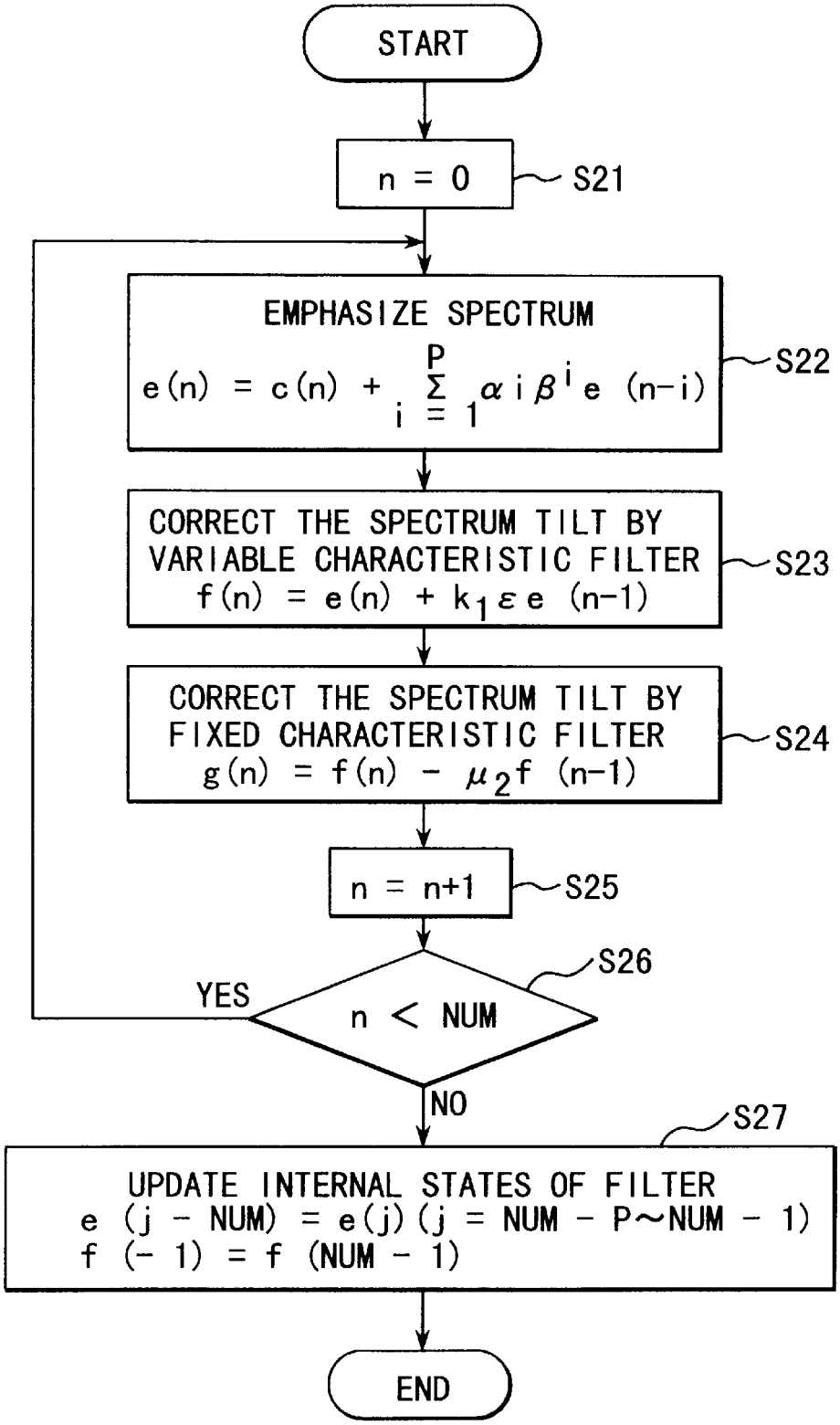
FIG. 6 is a flow chart showing a processing sequence when the filter coefficient determination section in FIG. 5 is used.

The above processing flow is summarized in the flow chart in FIG. 6. {c(n), n=0 to NUM−1} represent speech signals digitally processed and sequentially input to an input terminal 11. {e(n), n=−P to NUM−1} and {f(n), n=−1 to NUM−1} represent the internal states of the filter. {g(n), n=0 to NUM−1} represents output signals sequentially output from an output terminal 14. When a variable n of e(n) and f(n) has a negative value, it indicates use of the internal states of the previous frame. In the above expressions, NUM represents a frame length (NUM=40 in this case), and P represents the order of the spectrum emphasis filter (P=10 in this case). Steps S21, S22, S24, S25, S26, and S27 in FIG. 6 are identical to steps S11, S12, S14, S15, S16, and S17 in FIG. 3 described above, and a detailed description thereof will be omitted.

A newly added step in FIG. 6 is step S23. The characteristic feature of step S23 is to control the variable characteristic gradient correction with the first-order PARCOR coefficient k1. More specifically, the product of the first-order PARCOR coefficient k1 and the constant $\epsilon$ is used as the filter coefficient of the first-order zero filter to obtain f(n).

In the above processing, the order of steps S22, S23, and S24 is not predetermined. When the order is changed, the allocation of the internal states of the filter must be performed so as to match the changed order, as a matter of course.

Figure 7:
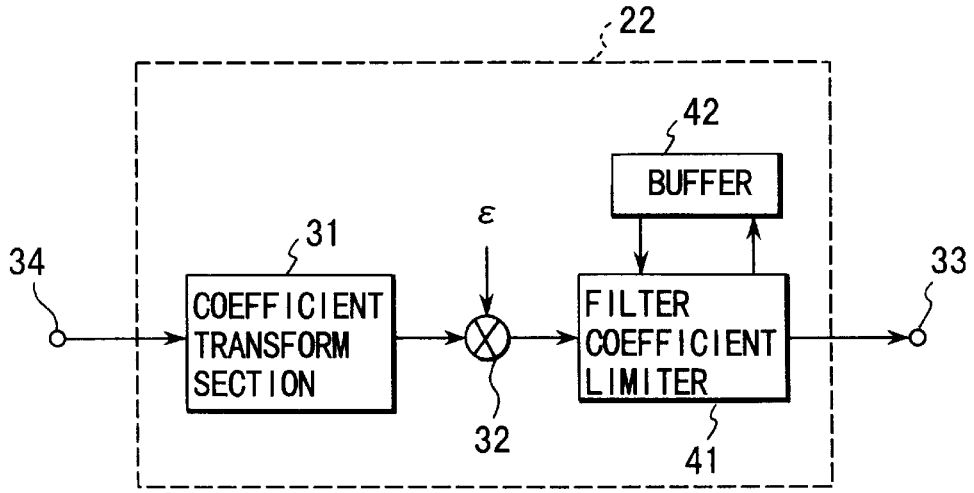
FIG. 7 is a block diagram showing another arrangement of the filter coefficient determination section according to the first and second embodiments.

FIG. 7 shows a modification of the filter coefficient determination section 22. The same reference numerals as in FIG. 5 denote the same parts in FIG. 7, and a detailed description thereof will be omitted. The filter coefficient determination section 22 in FIG. 7 is different from the filter coefficient determination section 22 in FIG. 5 in that the filter coefficient $\mu_1$ obtained on the basis of the current frame is limited to fall within the range defined by the $\mu_1$ value of the previous frame.

In the filter coefficient determination section 22 in FIG. 7, a buffer 42 for storing the filter coefficient $\mu_1$ of the previous frame is arranged. When $\mu_1$ of the previous frame is expressed as $\mu_1$p, this $\mu_1$p is used to limit the variation in $\mu_1$ in a filter coefficient limiter 41. The filter coefficient $\mu_1$ associated with the current frame obtained as the multiplication result in the multiplier 32 is input to the filter coefficient limiter 41. The filter coefficient $\mu_1$p stored in the buffer 42 is simultaneously input to the filter coefficient limiter 41. The filter coefficient limiter 41 limits the $\mu_1$ range so as to satisfy $\mu_1 p-T \leqq \mu_1 \leqq \mu_1 p+T$ where T is a positive constant:

$$\mu_1=\mu_1 P-T(\text{if } \mu_1<\mu_1 p-T) \tag{12}$$

$$\mu_1=\mu_1 P+T(\text{if } \mu_1>\mu_1 p+T) \tag{13}$$

After the above limitations are applied to $\mu_1$ in accordance with equations (12) and (13), this $\mu_1$ is output from an output terminal 33. At the same time, $\mu_1$ is stored in the buffer 42 as $\mu_1$p for the next frame.

As described above, the variation in the filter coefficient $\mu_1$ is limited to prevent a large change in characteristics of the variable characteristic filter 23. The variation in filter gain of the variable characteristic filter is also reduced. Therefore, discontinuity of the gains between the frames can be reduced, and a strange sound tends not to be produced.

Figure 8:
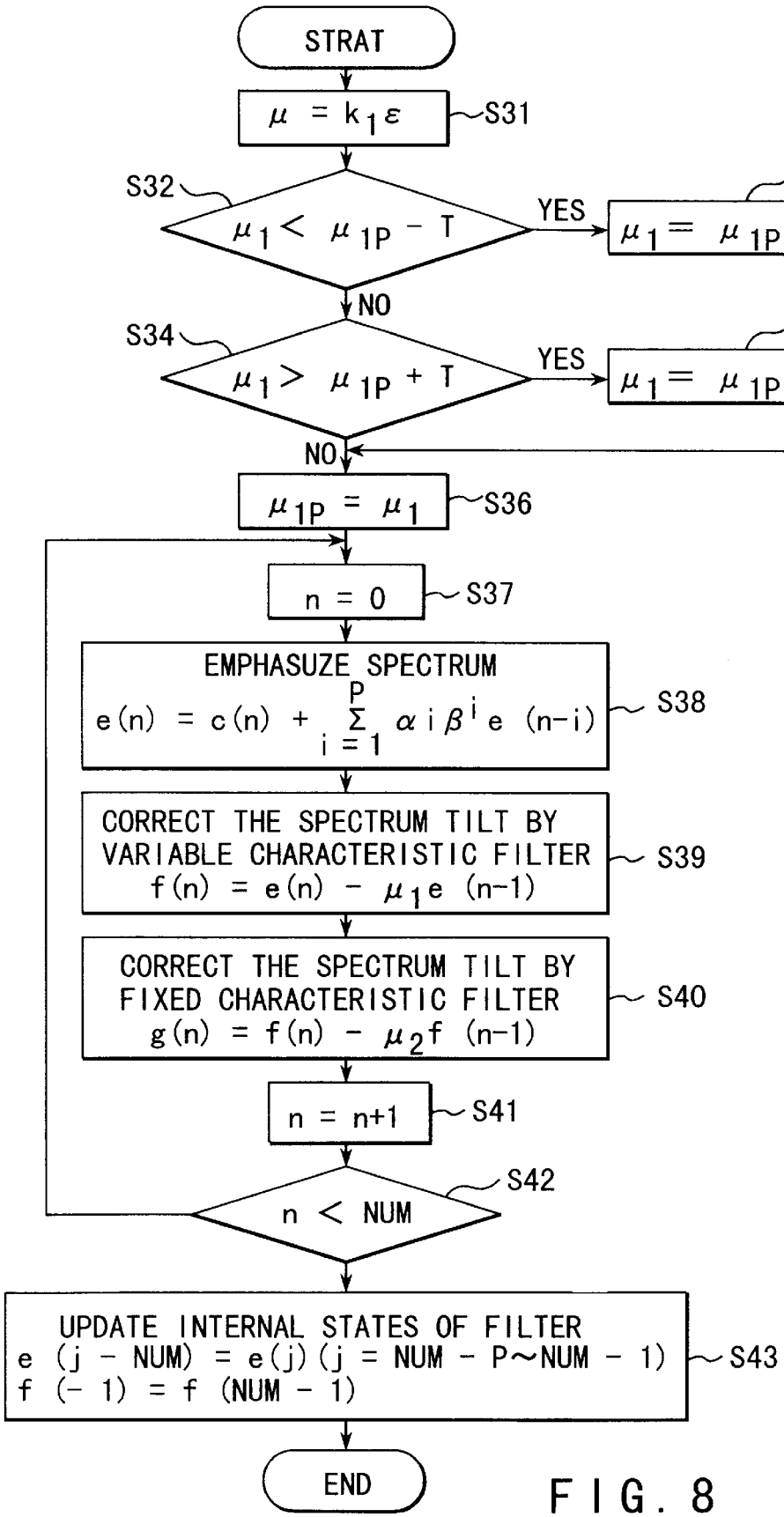
FIG. 8 is a flow chart showing a processing sequence when the filter coefficient determination section in FIG. 7 is used.

The above processing flow is summarized in the flow chart in FIG. 8. In this case, {c(n), n=0 to NUM−1} represents speech sounds digitally processed and sequentially input to the input terminal 11. {e(n), n=−P to NUM−1} and {f(n), n=−1 to NUM−1} represent the internal states of the filter. {g(n), n=0 to NUM−1} represents output signals sequentially output from the output terminal 14. When a variable n of e(n) and f(n) has a negative value, it indicates use of the internal states of the previous frame. In the above expressions, NUM represents a frame length (NUM=40 in this case), and P represents the order of the spectrum emphasis filter (P=10 in this case). Steps S37, S38, S39, S40, S41, S42, and S43 in FIG. 8 are identical to steps S11, S12, S13, S14, S15, S16, and S17 in FIG. 3 described above, and a detailed description thereof will be omitted.

Newly added steps in FIG. 8 are steps S31 to S36. The characteristic feature of these steps lies in that the characteristics of variable characteristic gradient correction processing are controlled by a first-order PARCOR coefficient k1, and a variation in the variable characteristic gradient correction processing is limited. Steps S31 to S36 will be described below.

In step S31, a variable $\mu_1$ is obtained from the product of the first-order PARCOR coefficient k1 and a constant $\epsilon$. In step S32, the variable $\mu_1$ is compared with $\mu_1$p−T. If $\mu_1$ is smaller than $\mu_1$p−T, the flow advances to step S33; otherwise, the flow advances to step S34. In step S33, the value of the variable $\mu_1$ is replaced with $\mu_1$p−T, and the flow advances to step S36. In step S34, the variable $\mu_1$ is compared with $\mu_1$p+T. If $\mu_1$ is larger than $\mu_1$p+T, the flow advances to step S33; otherwise, the flow advances to step S36. In step S33, the value of the variable $\mu_1$ is replaced with $\mu_1$p+T, and the flow advances to step S36. In step S36, the value of $\mu_1$ is updated as $\mu_1$p, and the flow advances to step S37.

In the above processing, the order of steps S38, S39, and S40 is not predetermined. When the order is changed, the allocation of the internal states of the filter must be performed so as to match the changed order, as a matter of course.

Figure 9:
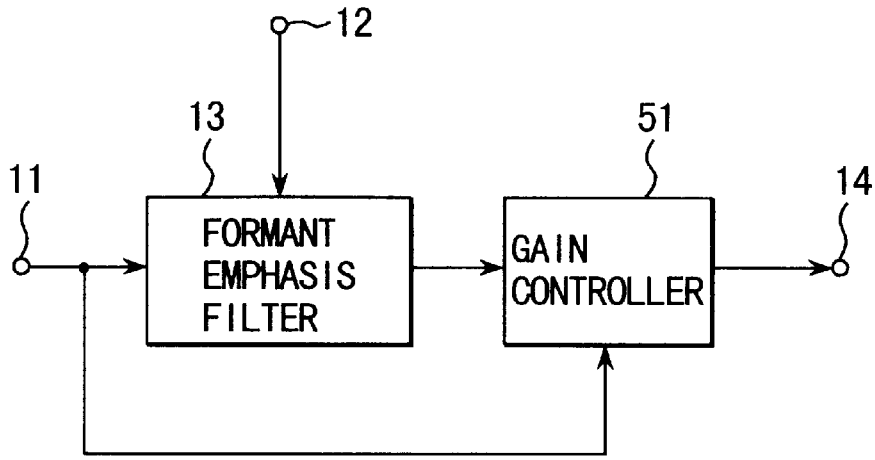
FIG. 9 is a block diagram showing a formant emphasis filter according to the third embodiment.

FIG. 9 is a block diagram of a formant emphasis filter according to the third embodiment. The third embodiment is different from the first embodiment in that a gain controller 51 is included in the constituent components.

The gain controller 51 controls the gain of an output signal from a formant emphasis filter 13 such that the power of the output signal from the filter 13 coincides with the power of a digitally processed speech signal serving as an input signal to the filter 13. The gain controller 51 also smooths the frames so as not to form a discontinuity between the previous frame and the current frame. By this processing, even if the filter gain of the formant emphasis filter 13 greatly varies, the gain of the output signal can be adjusted by the gain controller 51, and a strange sound can be prevented from being produced.

Figure 10:
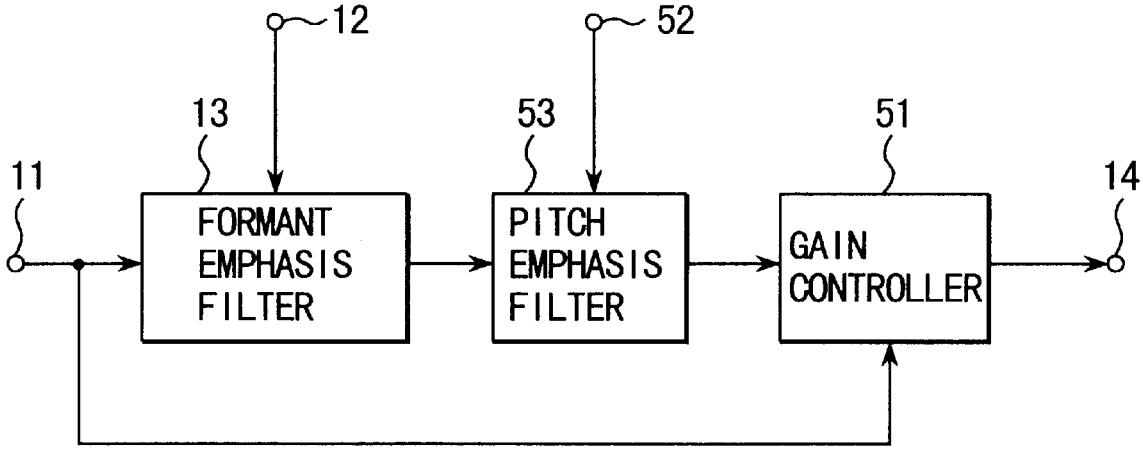
FIG. 10 is a block diagram showing a speech decoding device according to the fourth embodiment.

FIG. 10 is a block diagram showing a formant emphasis filter according to the fourth embodiment of the present invention. This formant emphasis filter is used together with a pitch emphasis filter 53 to constitute a formant emphasis filter device. The same reference numerals as in FIG. 9 denote the same parts in FIG. 10, and a detailed description thereof will be omitted.

A pitch period L and a filter gain $\delta$ are input from an input terminal 52 to the pitch emphasis filter 53. The pitch emphasis filter 53 also receives an output signal g(n) from the formant emphasis filter 13. When the z transform notation of the input speech signal g(n) input to the pitch emphasis filter 53 is defined as G(z), a z transform notation V(z) of an output signal v(n) is given as follows:

$$V(z)=\frac{1}{1-\delta z^{-L}}G(z) \tag{14}$$

This equation is expressed in a time domain to obtain equation (15) below:

$$v(n)=g(n)+\delta v(n-L) \tag{15}$$

The pitch emphasis filter 53 emphasizes the pitch of the output signal from the filter 13 on the basis of equation (15) and supplies the output signal v(n) to a gain controller 51.

As described above, when pitch emphasis processing is performed in addition to formant emphasis, noise suppression is further enhanced, and speech quality can be advantageously improved. The pitch emphasis filter 53 comprises a first-order all-pole pitch emphasis filter, but is not limited thereto. The arrangement order of the formant emphasis filter 13 and the pitch emphasis filter 53 is not limited to a specific order.

Recommended values of the respective constants of the present invention described above are given as follows:

$\beta=0.85$, $\epsilon=0.8$, $\mu_2=0.4$, T=0.3

These values are experimentally obtained by repeated listening of output samples. Other set values can be used depending on the favor of tone quality. The present invention is not limited to these set values, as a matter of course.

Figure 11:
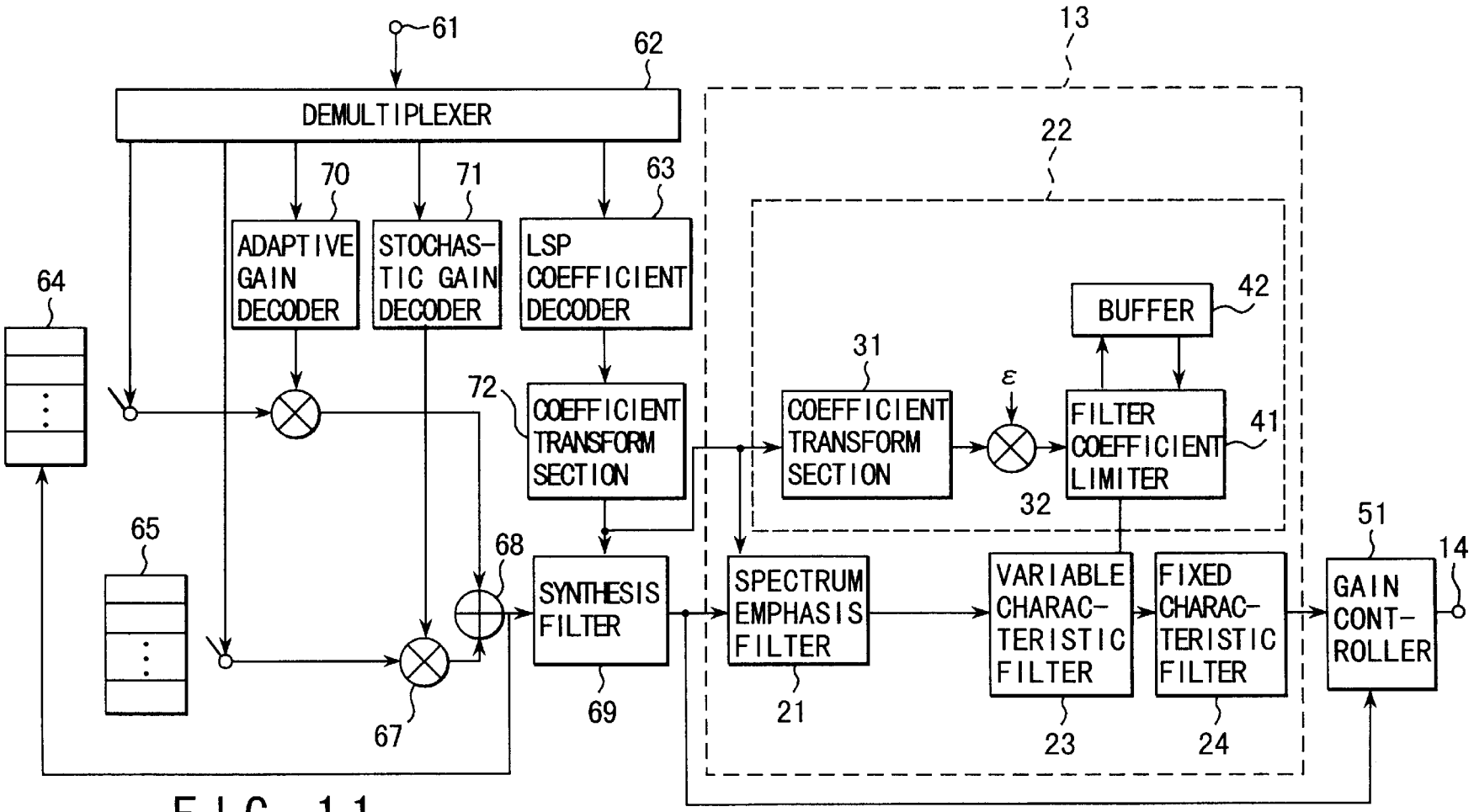
FIG. 11 is a block diagram showing a speech decoding device according to the fifth embodiment.

FIG. 11 shows the speech decoding device of a speech coding/decoding system, to which the present invention is applied, according to the fifth embodiment. The same reference numerals as in FIG. 2 denote the same parts in FIG. 11, and a detailed description thereof will be omitted.

Referring to FIG. 11, a bit stream transmitted from a speech coding apparatus (not shown) through a transmission line is input from an input terminal 61 to a demultiplexer 62. The demultiplexer 62 manipulates bits to demultiplex the input bit stream into an LSP coefficient index ILSP, an adaptive code book index IACB, a stochastic code book index ISCB, an adaptive gain index IGA, and a stochastic gain index IGS and to output them to the corresponding circuit elements.

An LSP coefficient decoder 63 decodes the LSP coefficient on the basis of the LSP coefficient index ILSP. A coefficient transform section 72 transforms the decoded LSP coefficient into an LPC coefficient. The transform method is described in Reference 5 described previously, and a detailed description thereof will be omitted. The resultant decoded LPC coefficient is used in a synthesis filter 69 and a formant emphasis filter 13.

An adaptive vector is selected from an adaptive code book 64 using the adaptive code book index IACB. Similarly, a stochastic vector is selected from a stochastic code book 65 on the basis of the stochastic code book index ISCB.

An adaptive gain decoder 70 decodes the adaptive gain on the basis of the adaptive gain index IGA. Similarly, a stochastic gain decoder 71 decodes the stochastic gain on the basis of the stochastic gain index IGS.

A multiplier 66 multiples the adaptive gain with the adaptive vector, a multiplier 67 multiples the stochastic gain with the stochastic vector, and an adder 68 adds the outputs from the multipliers 66 and 67, thereby generating an excitation vector. This excitation vector is input to the synthesis filter 69 and stored in the adaptive code book 64 for processing the next frame.

A excitation vector c(n) is defined as follows:

$$c(n)=a\cdot f(n)+b\cdot u(n) \tag{16}$$

where f(n) is the adaptive vector, a is the adaptive gain, u(n) is the stochastic vector, and b is the stochastic gain.

The synthesis filter 69 filters the excitation vector on the basis of the decoded LPC coefficient obtained from the coefficient transform section 72. More specifically, when the decoded LPC coefficient is defined as $\alpha i$ (i=1 to P, P: filter order), the synthesis filter 69 performs processing defined by the following equation:

$$e(n) = c(n) + \sum_{i=1}^{P} \alpha_i e(n-i) \tag{17}$$

where c(n) is the input excitation vector, and e(n) is the output synthesized vector.

The resultant synthesized vector e(n) and the decoded LPC coefficient $\alpha_i$ (i=1 to P) are input to the formant emphasis filter 13. As previously described, these inputs are subjected to formant emphasis. The gain of the formant-emphasized signal is controlled by the gain controller 51 using the gain of the synthesized vector e(n). The gain-controlled signal appears at an output terminal 14.

In the embodiment shown in FIG. 11, a formant emphasis filter having the arrangement shown in FIG. 2 is used as the formant emphasis filter 13, and a circuit having the arrangement shown in FIG. 4 is used as a filter coefficient determination section 22. However, a circuit having the arrangement shown in FIG. 5 may be used as the filter coefficient determination section 22. A combination of the formant emphasis filter 13 and the filter coefficient determination section 22 included therein can be arbitrarily determined.

Figure 12:
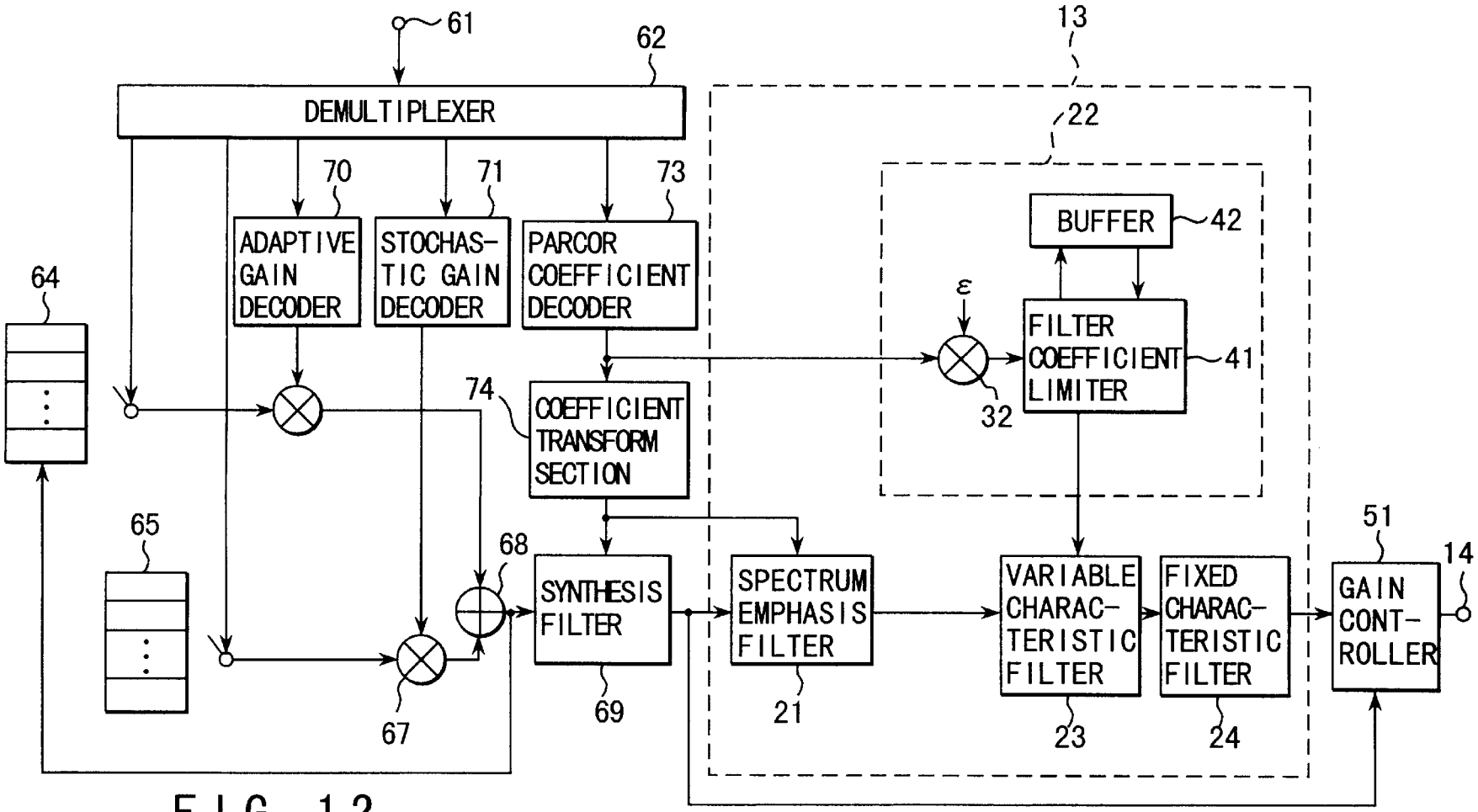
FIG. 12 is a block diagram showing a speech decoding device according to the sixth embodiment.

FIG. 12 shows a speech decoding device of a speech coding/decoding system, to which the present invention is applied, according to the sixth embodiment. The same reference numerals as in FIG. 11 denote the same parts in FIG. 12, and a detailed description thereof will be omitted.

While the LSP coefficient decoder 63 is used in the fifth embodiment, a PARCOR coefficient decoder 73 is used in the sixth embodiment. A coefficient which is to be decoded is determined by a coefficient coded by a speech coding apparatus (not shown). More specifically, if the speech coding device codes an LSP coefficient, the speech decoding device uses an LSP coefficient decoder 63. Similarly, a PARCOR coefficient is coded by the speech coding device, the speech decoding device uses the PARCOR coefficient decoder 73.

A coefficient transform section 74 transforms the decoded PARCOR coefficient into an LPC coefficient. The detailed arrangement method of this coefficient transform section 74 is described in Reference 5, and a detailed description thereof will be omitted. The resultant decoded LPC coefficient is supplied to a synthesis filter 69 and a formant emphasis filter 13. In this embodiment, since the PARCOR coefficient decoder 74 outputs the decoded PARCOR coefficient, the PARCOR coefficient need not be obtained using the coefficient transform section 31 of the filter coefficient determination section 22 in the previous embodiments. The decoded PARCOR coefficient as the output from the PARCOR coefficient decoder 73 is input to a filter coefficient determination section 22, thereby simplifying the circuit arrangement and reducing the processing quantity.

Figure 13:
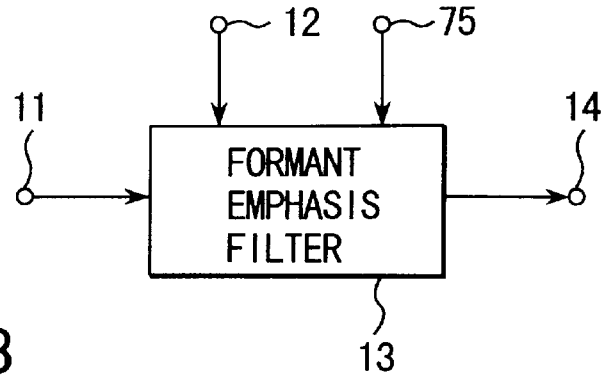
FIG. 13 is a block diagram showing the basic operation of the formant emphasis filter according to the sixth embodiment.

In this embodiment, as shown in FIG. 13, the formant emphasis filter 13 receives a speech signal from an input terminal 11, an LPC coefficient from an input terminal 12, and a PARCOR coefficient from an input terminal 75 and outputs a formant-emphasized speech signal from an output terminal 14. When the LPC and PARCOR coefficients can be obtained in the pre-processor of the formant emphasis filter 13, and these two coefficients are input to the formant emphasis filter 13, the coefficient transform section 31 in the filter coefficient determination section 22 in the formant emphasis filter 13 can be omitted from the formant emphasis filter device.

Figure 14:
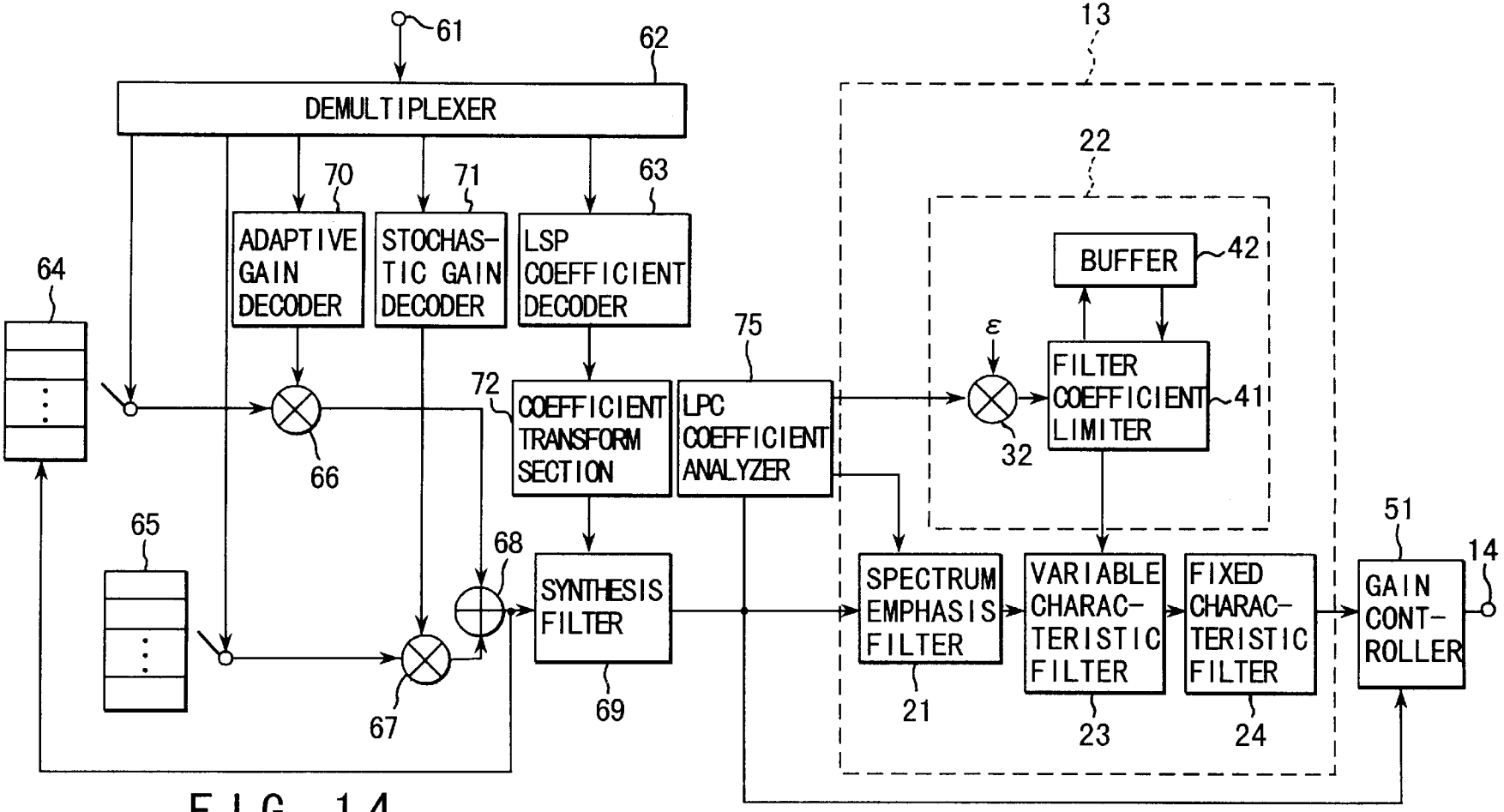
FIG. 14 is a block diagram showing a speech decoding device according to the seventh embodiment.

A filter having the arrangement in FIG. 2 is used as the formant emphasis filter 13 in FIG. 12, and a circuit having the arrangement shown in FIG. 7 is used as the filter coefficient determination section 22 in FIG. 12. A filter having the arrangement shown in FIG. 4 may be used as the formant emphasis filter 13, and a circuit having the arrangement shown in FIG. 5 may be used as the filter coefficient determination section 22. A combination of the formant emphasis filter 13 and the filter coefficient determination section 22 included therein is arbitrarily determined. FIG. 14 shows the speech decoding device of a speech coding/decoding system, to which the present invention is applied, according to the seventh embodiment. The same reference numerals as in FIG. 11 denote the same parts in FIG. 14, and a detailed description thereof will be omitted.

While the decoded LPC coefficient decoded by the decoder is input to the formant emphasis filter 13 and the decoded PARCOR coefficient is input to the formant emphasis filter 13, as needed, in the fifth and sixth embodiment, an output signal from a synthesis filter 69 is LPC-analyzed to obtain a new LPC coefficient or a PARCOR coefficient as needed, thereby performing formant emphasis using the obtained coefficient in the seventh embodiment. In the seventh embodiment, the LPC coefficient of the synthesized signal is obtained again, so that formant emphasis can be accurately performed. The LPC analysis order can be arbitrarily set. When the analysis order is large (analysis order>10), finer formant emphasis can be controlled.

An LPC coefficient analyzer 75 can analyze the LPC coefficient using an autocorrelation method or a covariance method. In the autocorrelation method, a Durbin's recursive solution method is used to efficiently solve the LPC coefficient. According to this method, both the LPC and PARCOR coefficients can be simultaneously obtained. Both the LPC and PARCOR coefficients are input to a formant emphasis filter 13. When the covariance method is used in the LPC coefficient analyzer 75, a Cholesky's resolution can efficiently solve an LPC coefficient. In this case, only the LPC coefficient is obtained. Only the LPC coefficient is input to the formant emphasis filter 13. FIG. 14 shows the speech decoding device having an arrangement using an LPC coefficient analyzer 75 using the autocorrelation method. This speech decoding device can be realized using an LPC coefficient analyzer using the covariance method.

A filter having the arrangement shown in FIG. 2 is used as the formant emphasis filter 13 in FIG. 14, and a circuit having the arrangement shown in FIG. 6 is used as a filter coefficient determination section 22. However, a filter having the arrangement in FIG. 4 may be used as the formant emphasis filter 13, and a circuit having the arrangement shown in FIG. 5 is used as the filter coefficient determination section 22. A combination of the formant emphasis filter 13 and the filter coefficient determination section 22 included therein is arbitrarily determined.

Figure 15:
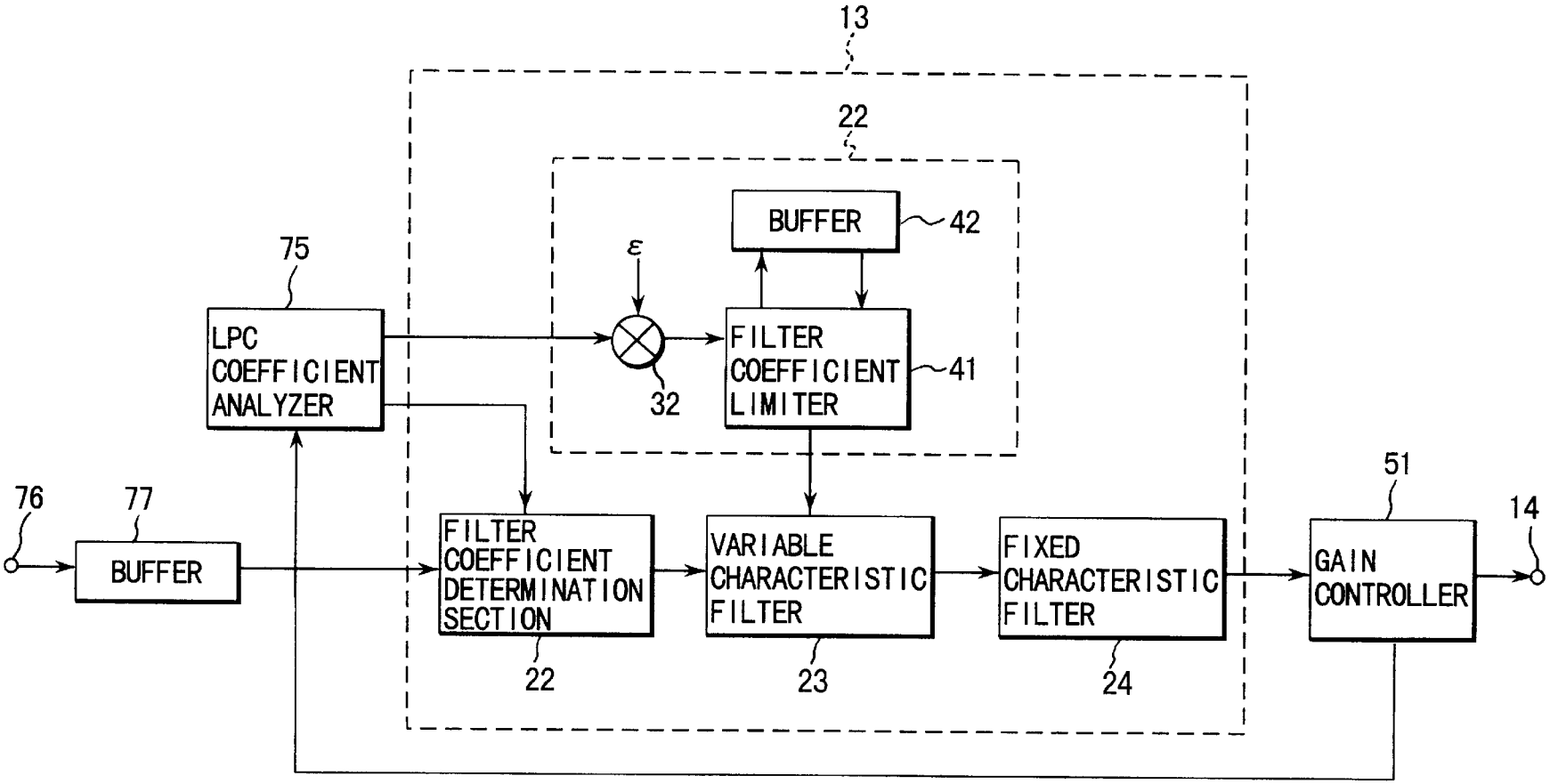
FIG. 15 is a block diagram showing a speech preprocessing device according to the eighth embodiment.

FIG. 15 is a block diagram showing the eighth embodiment. The same reference numerals as in FIG. 11 denote the same parts in FIG. 15, and a detailed description thereof will be omitted.

This embodiment aims at performing formant emphasis of a speech signal concealed in background noise, which is applied to a preprocessor in arbitrary speech processing. According to this embodiment, the formant of the speech signal is emphasized, and the valley of the speech spectrum is attenuated. The spectrum of the background noise superposed on the valley of the speech spectrum can be attenuated, thereby suppressing the noisy sound.

Referring to FIG. 15, digital input signals are sequentially input from an input terminal 76 to a buffer 77. When a predetermined number of speech signals (NF signals) are input to the buffer 77, the speech signals are transferred from the buffer 77 to an LPC coefficient analyzer 75 and a gain controller 51. A recommended NF value is 160. The LPC coefficient analyzer 75 uses the autocorrelation or covariance method, as described above. The analyzer 75 performs analysis according to the autocorrelation method in FIG. 15. According to the autocorrelation method, since both the LPC and PARCOR coefficients can be simultaneously obtained, LPC and PARCOR coefficients are input to a formant emphasis filter 13. Alternatively, the covariance method may be used in the LPC coefficient analyzer 75. In this case, only an LPC coefficient is input to the formant emphasis filter 13.

A filter having the arrangement in FIG. 2 is used as the formant emphasis filter 13 in FIG. 15, and a circuit having the arrangement shown in FIG. 6 is used as a filter coefficient determination section 22 in FIG. 15. A filter having the arrangement shown in FIG. 4 may be used as the formant emphasis filter 13, and a circuit having the arrangement shown in FIG. 5 may be use as the filter coefficient determination section 22. A combination of the formant emphasis filter 13 and the filter coefficient determination section 22 included therein is arbitrarily determined.

Figure 16:
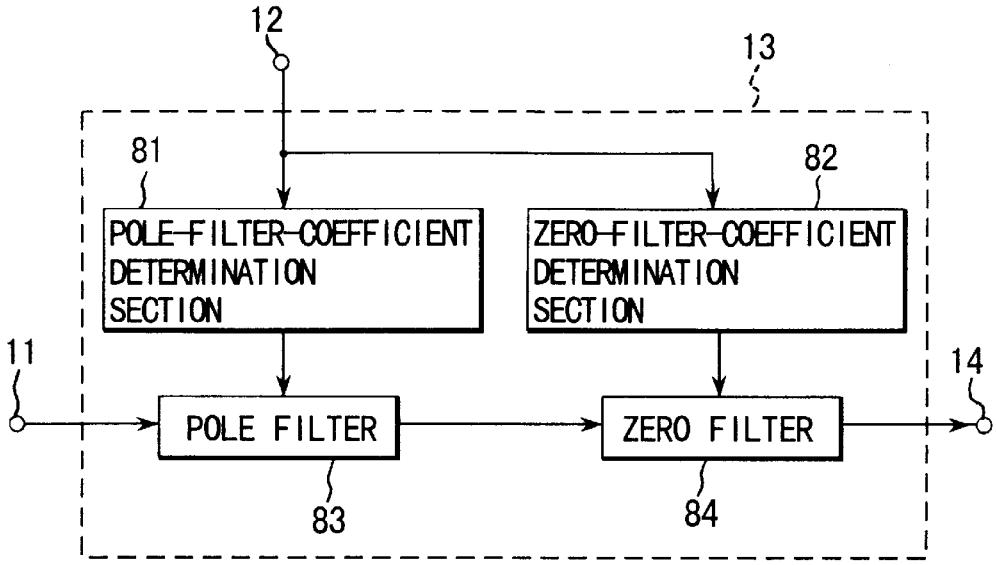
FIG. 16 is a block diagram showing a formant emphasis filter according to the ninth embodiment.

FIG. 16 is a block diagram showing the arrangement of a formant emphasis filter according to the ninth embodiment. The same reference numerals as in FIG. 2 denote the same parts in FIG. 16, and a detailed description thereof will be omitted. The ninth embodiment is different from the previous embodiments in a method of realizing a formant emphasis filter 13. The formant emphasis filter 13 of the ninth embodiment comprises a pole filter 83, a zero filter 84, a pole-filter-coefficient determination section 81 for determining the filter coefficient of the pole filter 83, and a zero-filter-coefficient determination section 82 for determining the filter coefficient of the zero filter 84.

The pole filter 83 serves as a main filter for achieving the basic operation of the formant emphasis filter 13 such that the spectral formant of the input speech signal is emphasized and the spectral valley of the input signal is attenuated. The zero filter 84 compensates a spectral tilt generated by the pole filter 83. The operation of the formant emphasis filter of the ninth embodiment will be described with reference to FIG. 16.

LPC coefficients representing the spectrum outline of the speech signal are sequentially input from an input terminal 12 to the pole-filter-coefficient determination section 81 and the zero-filter-coefficient determination section 82. The pole-filter-coefficient determination section 81 obtains filter coefficients q(i) (i=1 to P) of the pole filter 83 on the basis of the input LPC coefficients. Similarly, the zero-filter-coefficient determination section 82 obtains filter coefficients r(i) (i=1 to P) of the zero filter 84. The detailed processing methods of the pole-filter-coefficient determination section 81 and the zero-filter-coefficient determination section 82 will be described later. The speech signals input from an input terminal 11 are sequentially filtered through the pole filter 83 and the zero filter 84, so that a formant-emphasized signal appears at an output terminal 14.

When the transfer functions of the pole and zero filters 83 and 84 are expressed in a z transform domain, the z transform notation of the output signal is defined as equation (18):

$$G(z) = \frac{1 - \sum_{i=1}^{P} r(i)z^{-i}}{1 - \sum_{i=1}^{P} q(i)z^{-i}} C(z) \tag{18}$$

where C(z) is the z transform value of the input speech signal, and G(z) is the z transform value of the output signal.

Equation (18) is expressed in the time region as follows:

$$g(n) = c(n) - \sum_{i=1}^{P} r(i)c(n-i) + \sum_{i=1}^{P} q(i)g(n-i) \tag{19}$$

where c(z) is the time region signal of C(z), and g(n) is the time region signal of G(z).

The pole-filter-coefficient determination section 81 and the zero-filter-coefficient determination section 82 will be described in detail below.

Figure 17:
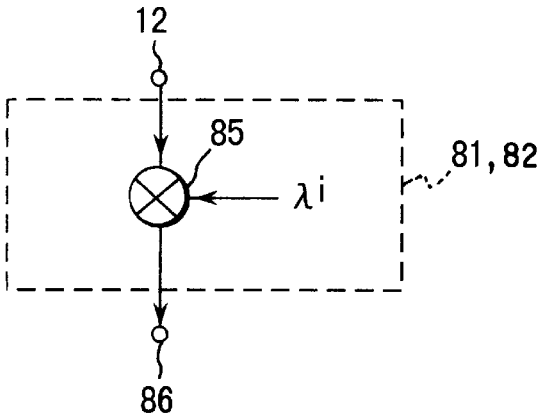
FIG. 17 is a block diagram showing a filter coefficient determination section according to the ninth embodiment.

FIG. 17 is a block diagram showing the first arrangement of a filter coefficient determination section to be applied to the pole-filter-coefficient determination section 81 and the zero-filter-coefficient determination section 82. Referring to FIG. 17, the coefficients of each order of LPC coefficients $\alpha_i$ (i=1 to P) input from the input terminal 12 are multiplied by a multiplier 85 with a value represented by a constant $\lambda^i$ (i: LPC coefficient order). The resultant filter coefficients are output from an output terminal 86. For example, when the filter coefficient determination section having the arrangement shown in FIG. 17 is used as the pole-filter-coefficient determination section 81, the filter coefficients q(i) (i=1 to P) of the pole filter 83 are defined by equation (20) below:

$$q(i)=\alpha_i\lambda^i \tag{20}$$

Similarly, filter coefficients r(i) (i=1 to P) of the zero filter 84 are determined by the zero-filter-coefficient determination section 82 by equation (21) below:

$$r(i)=\alpha_i\lambda^i \tag{21}$$

Figure 18:
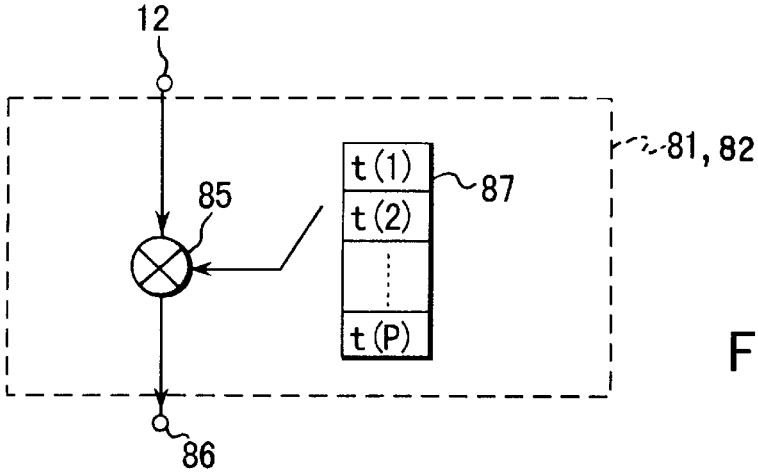
FIG. 18 is a block diagram showing another filter coefficient determination section according to the ninth embodiment.

The second arrangement of a filter coefficient determination section to be applied to the pole-filter-coefficient determination section 81 and the zero-filter-coefficient determination section 82 will be described with reference to FIG. 18. The arrangement in FIG. 18 is different from that in FIG. 17 in that a memory table 87 which stores a constant to be multiplied with coefficients of each order of the LPC coefficients is arranged. Referring to FIG. 18, the coefficients of each order of the LPC coefficients $\alpha_i$ (i=1 to P) input from the input terminal 12 are multiplied by a multiplier 85 with constants t(i) (i=1 to P) arbitrarily determined in correspondence with the coefficients of each order and stored in the memory table 87. For example, when the filter coefficient determination section having the arrangement shown in FIG. 18 is used as the pole-filter-coefficient determination section 81, the filter coefficients q(i) (i=1 to P) of the pole filter 83 are determined by equation (22) below:

$$q(i)=\alpha_i t(i) \tag{22}$$

The filter coefficients r(i) (i=1 to P) of the zero filter 84 are determined by the zero-filter-coefficient determination section 82 by equation (23) below:

$$r(i)=\alpha_i t(i) \tag{23}$$

The characteristic feature of this embodiment lies in that at least one of the pole-filter-coefficient determination section 81 and the zero-filter-coefficient determination section 82 is constituted using the memory table 87, as shown in FIG. 18. Generally, memory table for pole-filter-coefficient determination section 81 and memory table for zero-filter-coefficient determination section 82 are not identical. Because the pole-zero filtering process is equivalent to omitting if the memory tables are identical. With this arrangement, the filter coefficients to be multiplied with the LPC coefficients to obtain the filter coefficients are not limited to the exponential function values, but can be freely set using the memory table 87. Therefore, high-quality speech can be obtained by the formant emphasis filter 13. That is, filter coefficients determined to obtain speech outputs in accordance with the favor of a user are stored in the memory table, and these coefficients are multiplied with the LPC coefficients input from the input terminal 12 to obtain desired sounds.

Figure 19:
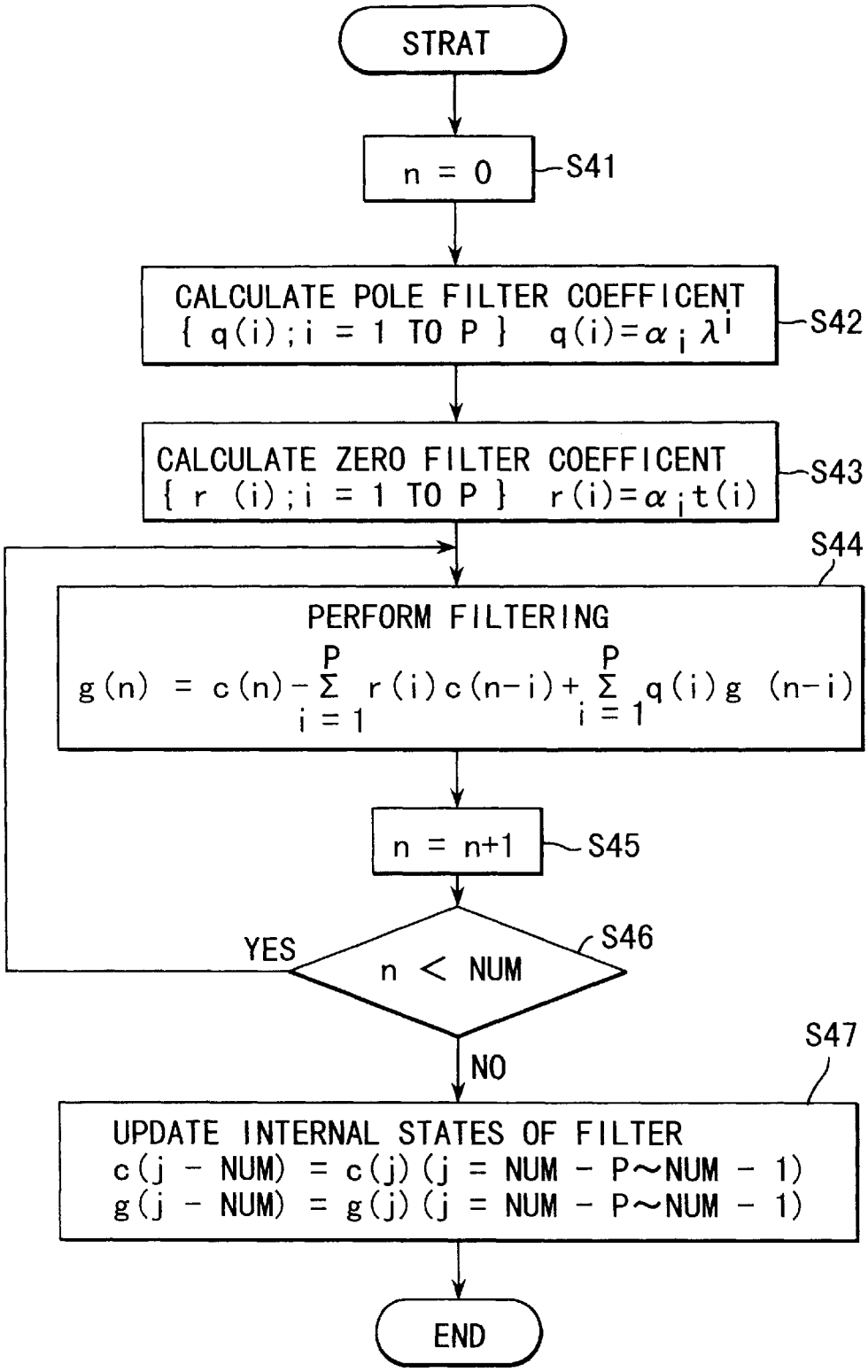
FIG. 19 is a flow chart showing a processing sequence according to the ninth embodiment.

The above processing flow is summarized in the flow chart in FIG. 19. {c(n), n=−P to NUM−1} represents signals sequentially input from the input terminal 11, and {g(n), n=−P to NUM−1} represents an output signal. A variable n of e(n) and f(n) which has a negative value represents use of the internal states of the previous frame. In the above expressions, NUM represents a frame length (NUM=40 in this case), and P represents the order of the spectrum emphasis filter (P=10 in this case). Steps S41, S45, and S46 in FIG. 19 are identical to steps S11, S15, and S16 in FIG. 3 described above, and a detailed description thereof will be omitted.

Newly added steps in FIG. 19 are steps S42 to S44, and step S47. The characteristic features of these steps lie in filtering using a Pth-order pole filter and a Pth-order zero filter, a method of calculating the filter coefficients of the pole and zero filters, and a method of updating the internal states of the filter. Steps S42 to S44 and step S47 will be described below.

In step S42, filter coefficients q(i) (i=1 to P) of the pole filter are calculated according to equation (20) using LPC coefficients $\alpha_i$(i=1 to P) representing the spectrum envelope of an input speech signal. In steps S43, filter coefficients r(i) (i=1 to P) of the zero filter are calculated according to equation (23). In step S44, filtering processing of the pole and zero filters is performed according to equation (19). In step S47, the internal states of the filter are updated for the next frame in accordance with equations (24) and (25):

$$c(j-\text{NUM})=c(j)\ (j=\text{NUM}-P \text{ to NUM}-1) \tag{24}$$

$$g(j-\text{NUM})=g(j)\ (j=\text{NUM}-P \text{ to NUM}-1) \tag{25}$$

In the above processing, equation (20) is used to obtain the filter coefficients of the pole filter, and equation (23) is used to obtain the filter coefficients of the zero filter. However, the present invention is not limited to this. At least one of the filter coefficients of the pole and zero filters may be calculated in accordance with equation (22) or (23). The filtering order in filtering processing in step S44 can be arbitrarily determined. When the order is changed, allocation of the internal states of the formant emphasis filter 13 must be performed in accordance with the changed order.

Figure 20:
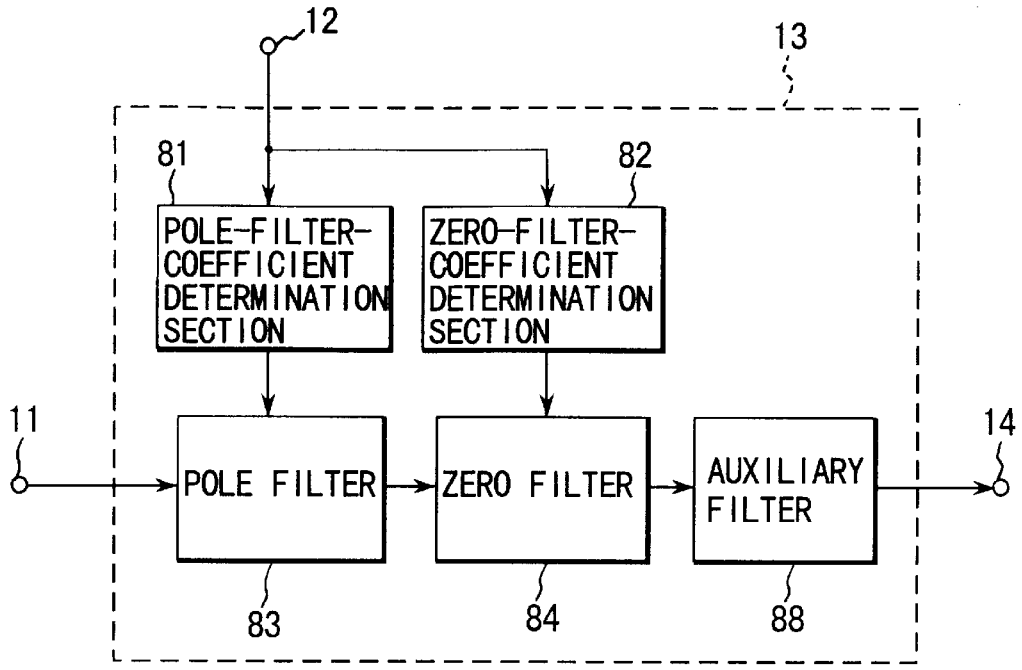
FIG. 20 is a block diagram showing a formant emphasis filter according to the 10th embodiment.

FIG. 20 is a block diagram showing the arrangement of a formant emphasis filter 13 according to the 10th embodiment. The arrangement in FIG. 20 is different from that in FIG. 16 in that an auxiliary filter 88 operating to help the action of a zero filter 84 for compensating a spectral tilt inherent to a pole filter 83 is arranged. Generally, the spectral tilt contained in the pole filter 83 is not sufficiently compensated by the zero filter 84. Therefore, the auxiliary filter 88 is effective for helping the compensation of the spectral tilt. The fixed characteristic filter 24 described above may be used as this auxiliary filter 88, because the almost region of the speech has a low-pass characteristic such as vowel. Since the auxiliary filter 88, however, aims at compensating the spectral tilt of the zero filter 84 as described above, the characteristics need not be necessarily fixed. For example, a filter whose characteristics change depending on a parameter capable of expressing the spectral tilt, such as a PARCOR coefficient, may be used. The order of the above filters is not limited to the one shown in FIG. 20, but can be arbitrarily determined.

Figure 21:
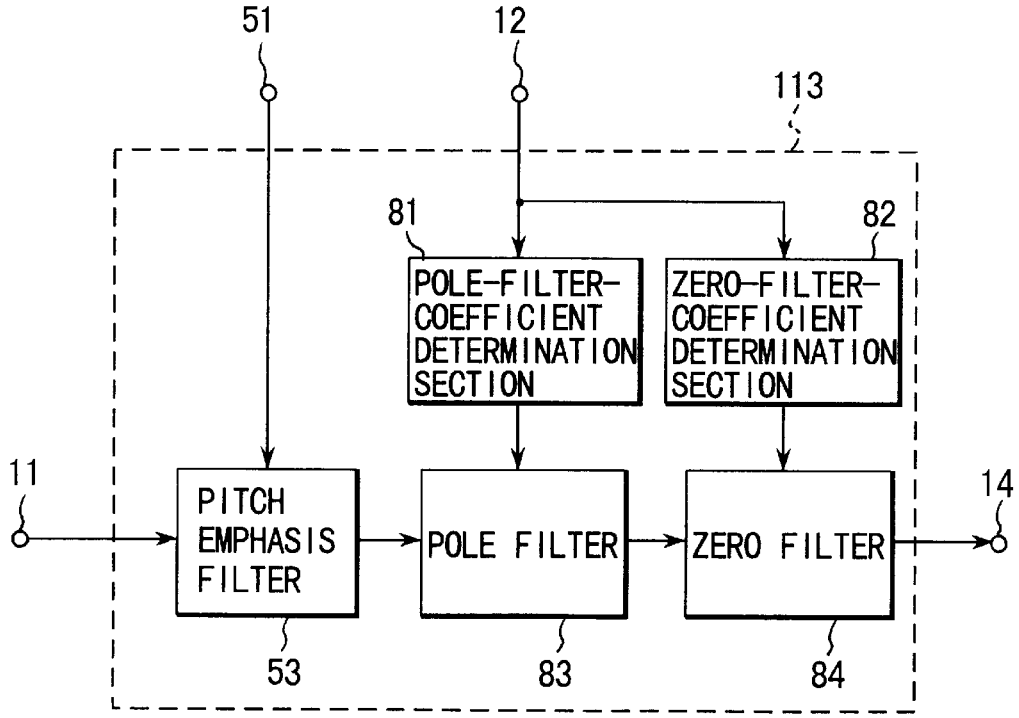
FIG. 21 is a block diagram showing a formant emphasis filter according to the 11th embodiment.

FIG. 21 is a block diagram showing the arrangement of a formant emphasis filter device 13 according to the 11th embodiment of the present invention. This embodiment is different from that of FIG. 16 in that a pitch emphasis filter 53 is added to the formant emphasis filter device 13. In this case, the order of filters is not limited to the one shown in FIG. 21, but can be arbitrarily determined.

Figure 22:
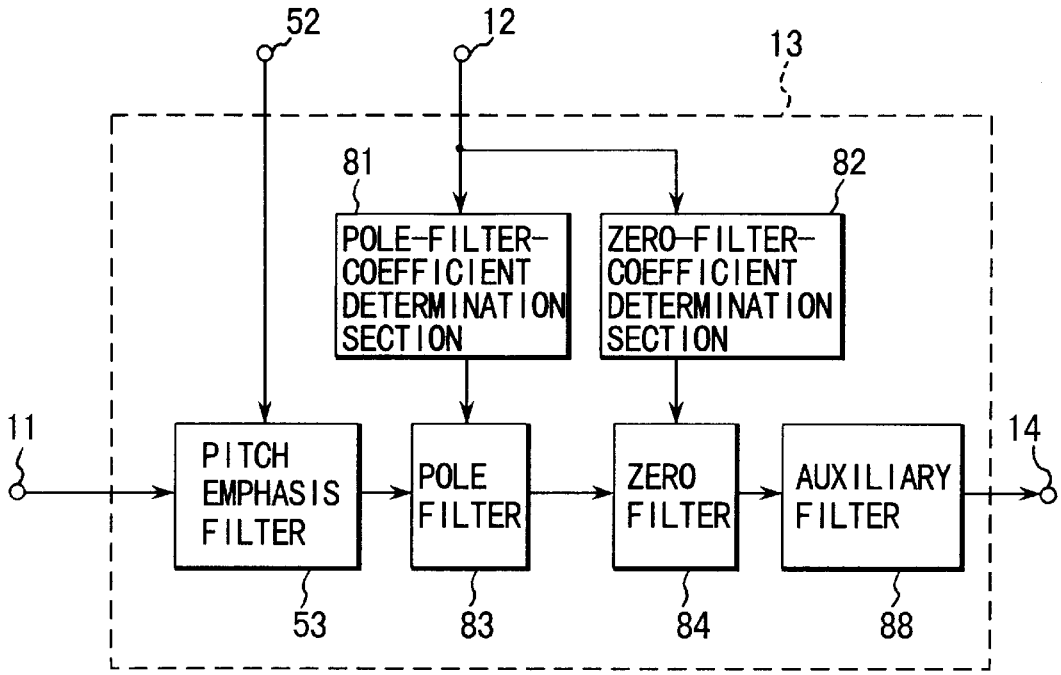
FIG. 22 is a block diagram showing a formant emphasis filter according to the 12th embodiment.

FIG. 22 is a block diagram showing the arrangement of a formant emphasis filter device 13 according to the 12th embodiment of the present invention. This embodiment is different from that of FIG. 16 in that an auxiliary filter 88 and a pitch emphasis filter 53 are arranged. In this case, the order of filters can be arbitrarily determined.

Figure 23:
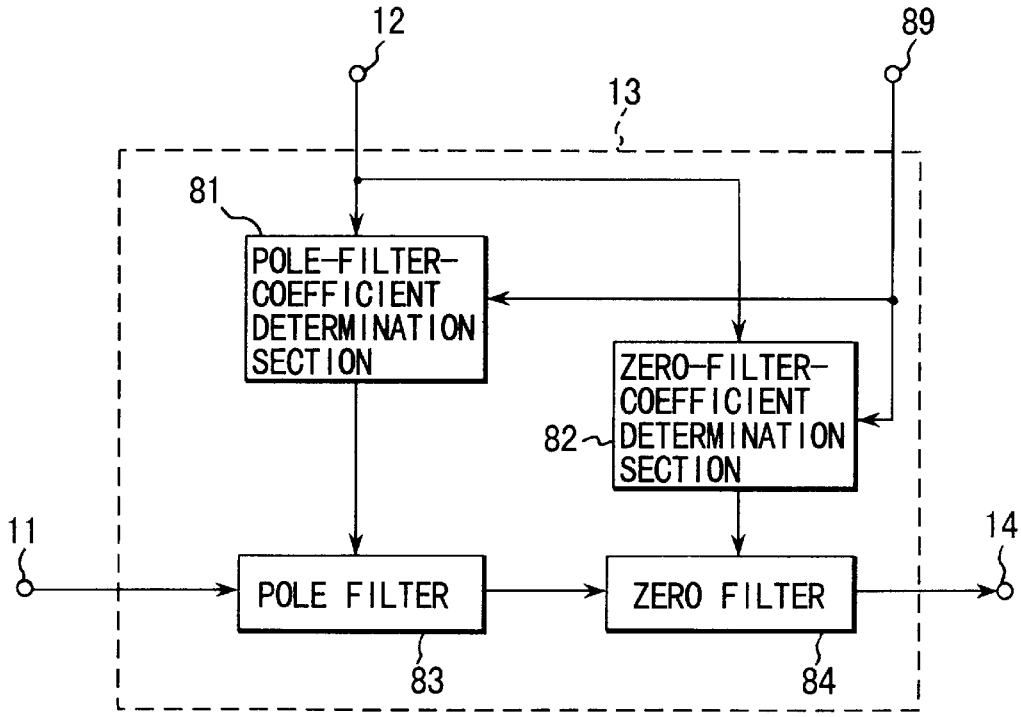
FIG. 23 is a block diagram showing a formant emphasis filter according to the 13th embodiment.

FIG. 23 is a block diagram showing the arrangement of a formant emphasis filter 13 according to the 13th embodiment. According to the characteristic feature of this embodiment, a pole-filter-coefficient determination section 81 and a zero-filter-coefficient determination section 82 have M ($M \geqq 2$) constants $\lambda_m$ (m=1 to M) or memory tables $t_m(i)$ (i=1 to P, m=1 to M), and one of the M constants or the m memory tables is selected in accordance with an attribute of an input speech signal and used to determine a filter coefficient.

The operation will be described below, paying attention to the feature of this embodiment. Assume that filter coefficients of the pole-filter-coefficient determination section 81 are determined by equation (20) using M ($M \geqq 2$) constants $\lambda_m$, and that the zero-filter-coefficient determination section 82 determines the filter coefficients by equation (23) using the memory tables $t_m(i)$ (i=1 to P). At least one of the pole-filter-coefficient determination section 81 and the zero-filter-coefficient determination section 82 determines the filter coefficient using the memory table in accordance with equation (22) or (23), and the arrangement of these sections is not limited to the one described above.

Referring to FIG. 23, attribute information representing an attribute of an input speech signal is input from an input terminal and is supplied to the pole-filter-coefficient determination section 81 and the zero-filter-coefficient determination section 82. The pole-filter-coefficient determination section 81 one of the M constants $\lambda_m$ (m=1 to M) on the basis of the input attribute information and calculates the coefficient of a pole filter 83 in accordance with equation (20) using the selected $\lambda_m$. Similarly, the zero-filter-coefficient determination section 82 selects one of the memory tables from the constants $t_m(i)$ (i=1 to P, m=1 to M) stored in the M memory tables on the basis of the input attribute information and determines the filter coefficient of a zero filter 84 in accordance with equation (23) using the constant $t_m(i)$ (i=1 to P) stored in the selected memory table.

The attribute information of the input speech signal is information representing, e.g., a vowel region, a consonant region, or a background region. When the attributes are classified as described above, the formant is emphasized in the vowel region, and the formants are weakened in the consonant and background regions, thereby obtaining the best effect. As an attribute classification method, for example, a feature parameter such as a first-order PARCOR coefficient or a pitch gain, or a plurality of feature parameters as needed may be used to classify the attributes.

Figure 24:
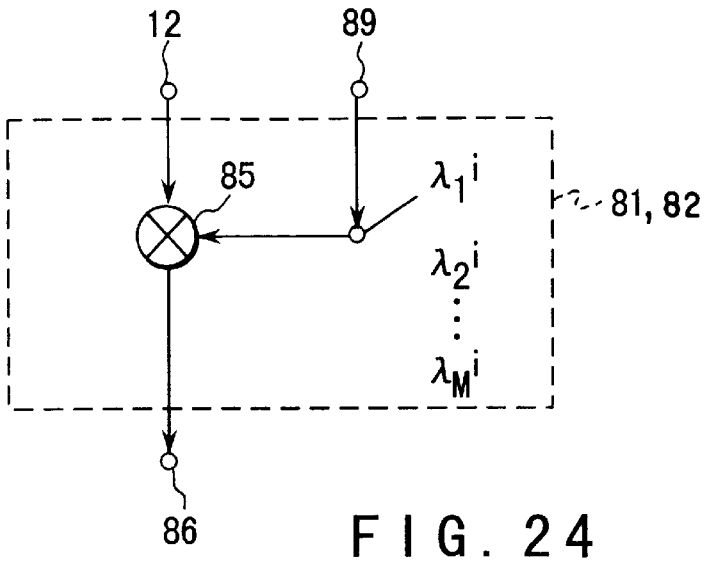
FIG. 24 is a block diagram showing an arrangement of a filter coefficient determination section according to the 13th embodiment.

FIG. 24 is a block diagram showing the first arrangement of a filter coefficient determination section applied to the pole-filter-coefficient determination section 81 and the zero-filter-coefficient determination section 82 in FIG. 23. One of the M constants $\lambda_m$ (m=1 to M) is selected on the basis of the attribute information input from an input terminal 89. Coefficients of each order of LPC coefficients $\lambda_i$ (i=1 to P) input from an input terminal 12 are multiplied with the constant $\lambda_m{}^i$ (i: LPC coefficient order), and the resultant filter coefficients appear at an output terminal 86.

Figure 25:
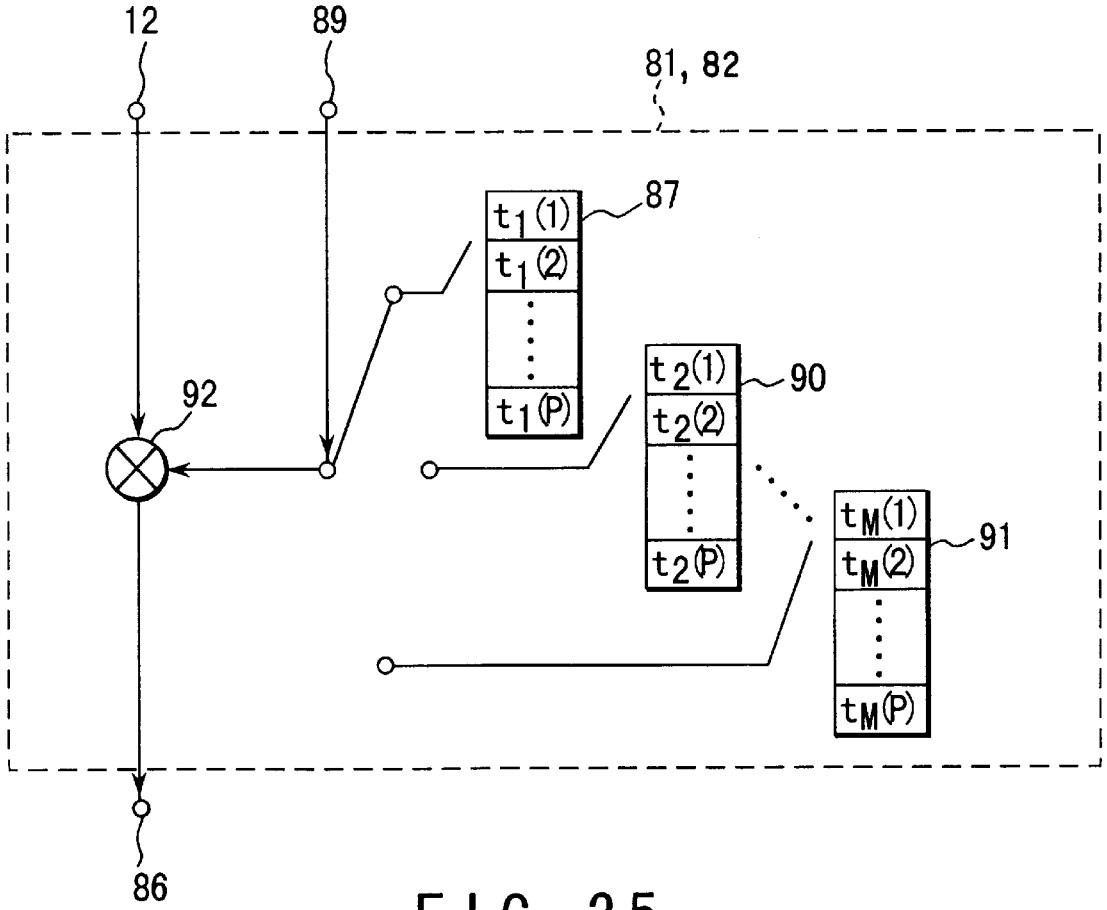
FIG. 25 is a block diagram showing another arrangement of the filter coefficient determination section according to the 13th embodiment.

FIG. 25 is a block diagram showing the second arrangement of a filter coefficient determination section applied to the pole-filter-coefficient determination section 81 and the zero-filter-coefficient determination section 82 in FIG. 23. One of the memory tables from the constants $t_m(i)$ (i=1 to P, m=1 to M) stored in M memory tables 87, 90, and 91 is selected on the basis of the attribute information input from the input terminal 89, and the constant $t_m(i)$ (i=1 to P) is extracted from the selected memory table. The constant $t_m(i)$ extracted from the selected memory table is multiplied with the coefficients of each order of the LPC coefficients $\alpha i$ (i=1 to P), and the resultant filter coefficients appear at the output terminal 86.

Figure 28:
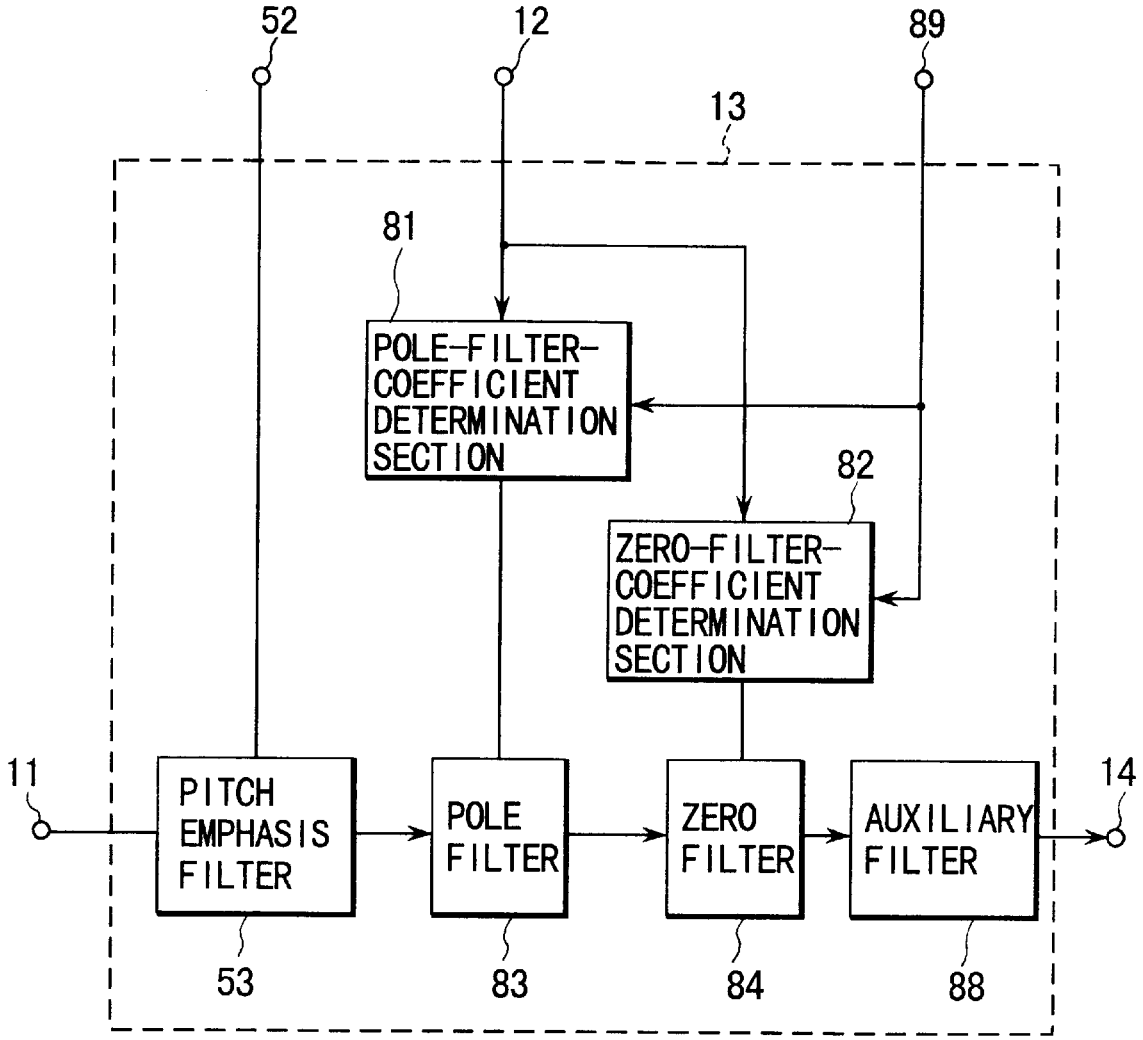
FIG. 28 is a block diagram showing a formant emphasis filter according to the 16th embodiment.
Figure 29:
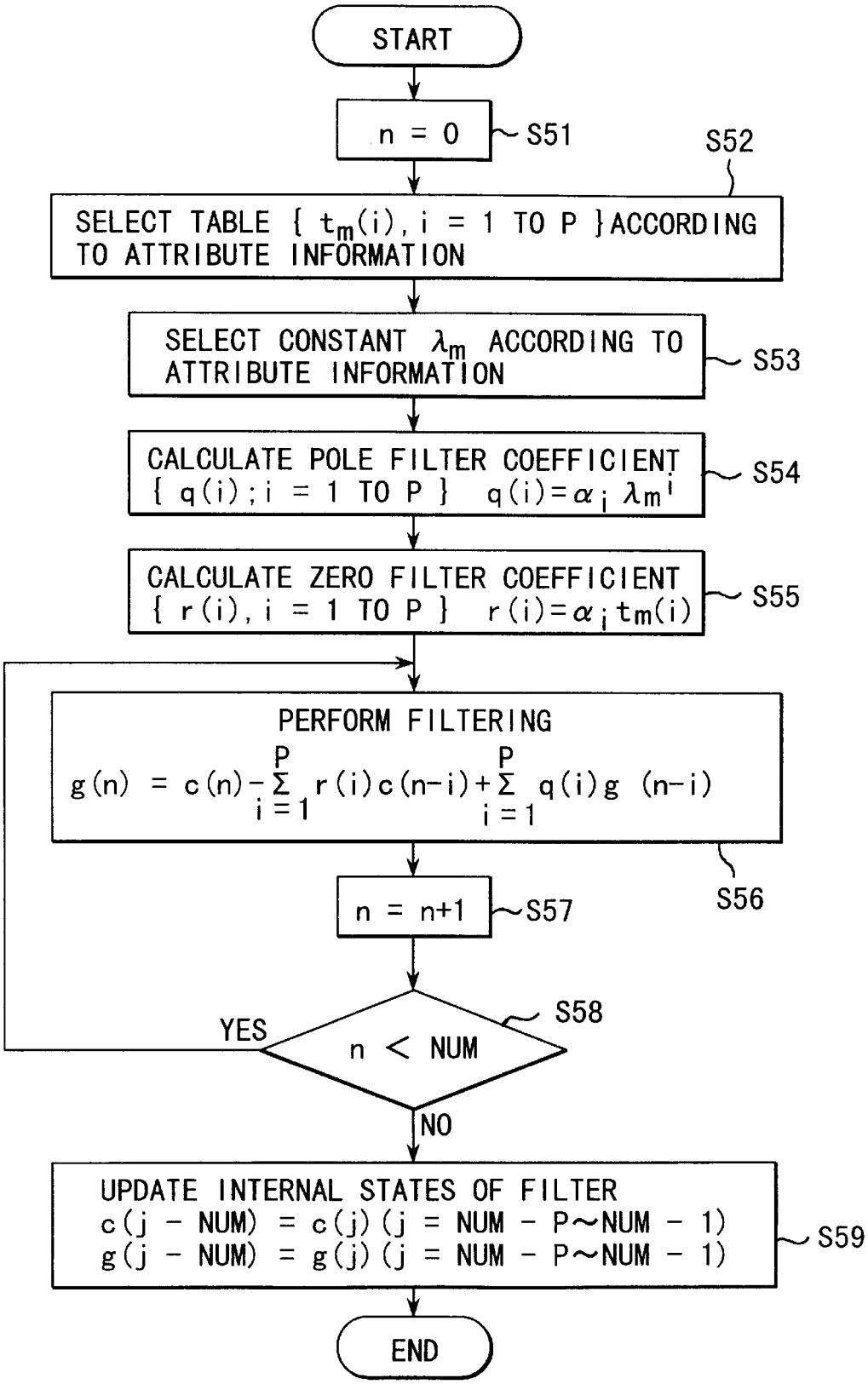
FIG. 29 is a flow chart showing a processing sequence according to the 13th to 16th embodiments.

The above processing flow is summarized in the flow chart in FIG. 29. {c(n), n=−P to NUM−1] represents signals sequentially input from the input terminal 11, and {g(n), n=−P to NUM−1} represents an output signal. A variable n of c(n) and g(n) which has a negative value represents use of the internal states of the previous frame. In the above expressions, NUM represents a frame length (NUM=40 in this case), and P represents the order of the spectrum emphasis filter (P=10 in this case). Steps S51, S54, S55, S56, S57, S58, and S59 in FIG. 29 are identical to steps S41, S42, S43, S44, S45, S46, and S47 in FIG. 28 described above, and a detailed description thereof will be omitted.

Newly added steps in FIG. 29 are steps S52 and S53. The characteristic features of this processing lie in step S52 for selecting a constant stored in one memory table from the constants $t_m(i)$ (i=1 to P, m=1 to M) stored in the M memory tables on the basis of the attribute information of the input speech signal, and step S53 for selecting one of the M constants $\lambda_m$ (m=1 to M) on the basis of the input attribute information.

Figure 26:
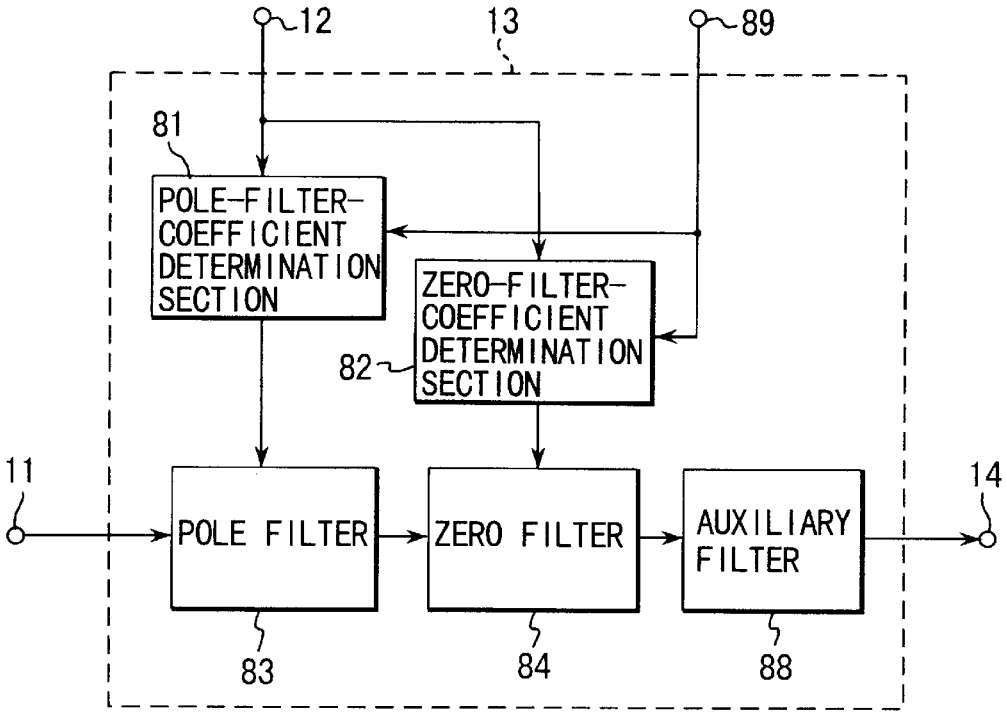
FIG. 26 is a block diagram showing a formant emphasis filter according to the 14th embodiment.

FIG. 26 is a block diagram showing the arrangement of a formant emphasis filter 13 according to the 14th embodiment. An auxiliary filter 88 is added to the arrangement of FIG. 23.

Figure 27:
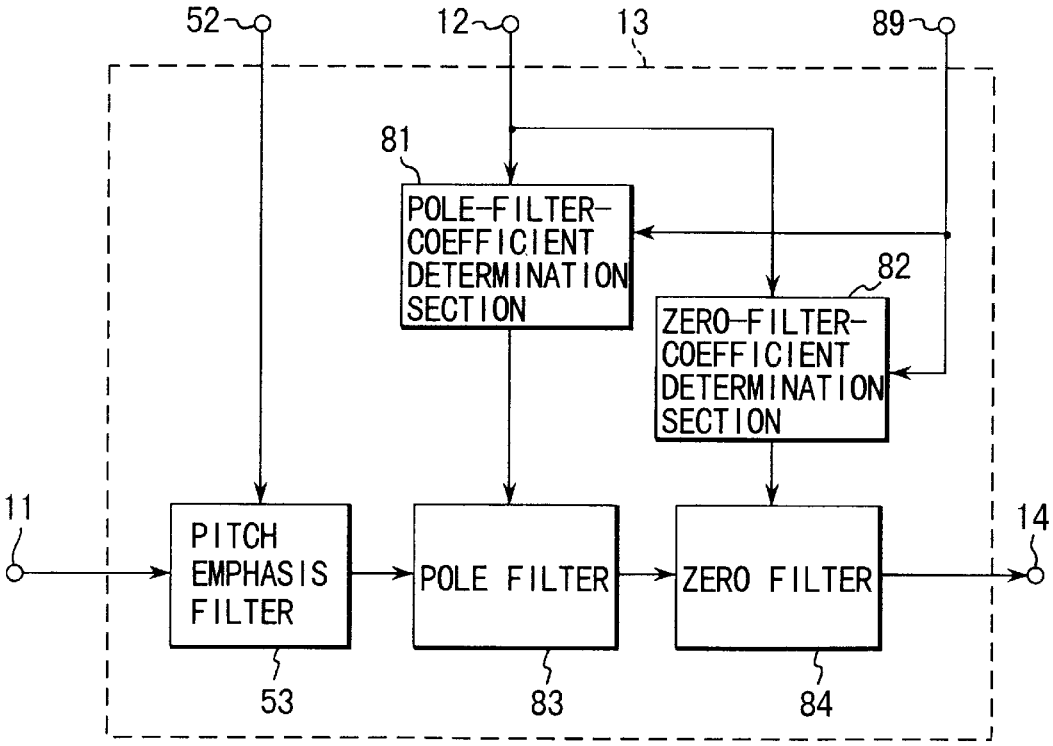
FIG. 27 is a block diagram showing a formant emphasis filter according to the 15th embodiment.

FIG. 27 is a block diagram showing the arrangement of a formant emphasis filter 13 according to the 15th embodiment. A pitch emphasis filter 53 is added to the arrangement of FIG. 23.

FIG. 28 is a block diagram showing the arrangement of a formant emphasis filter 13 according to the 16th embodiment. An auxiliary filter 88 and a pitch emphasis filter 53 are added to the arrangement of FIG. 23.

The order of the filters can be arbitrarily changed in the 14th to 16th embodiments.

Figure 30:
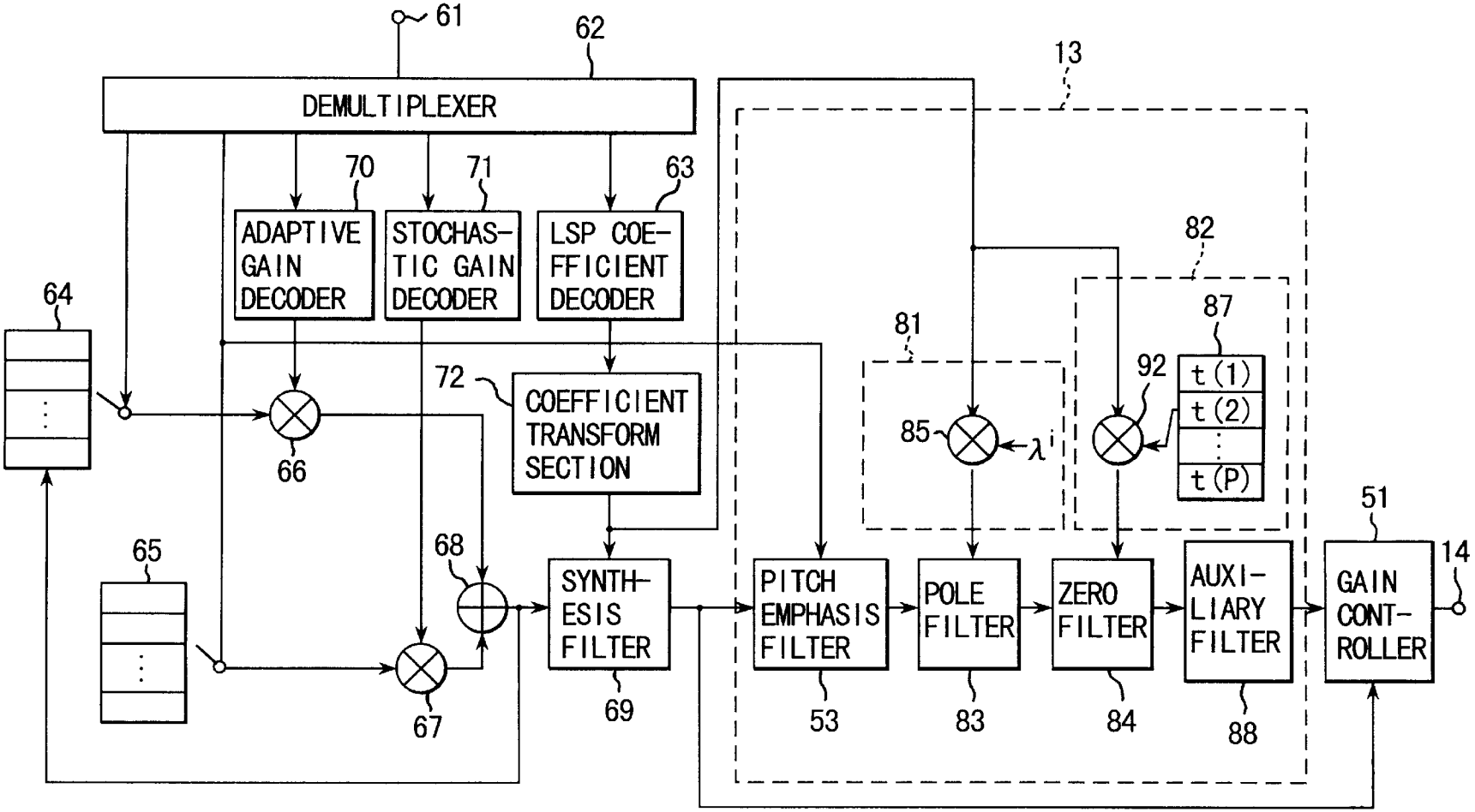
FIG. 30 is a block diagram showing a speech decoding device according to the 17th embodiment.

FIG. 30 shows the speech decoding device of a speech coding/decoding system, to which the present invention is applied, according to the 17th embodiment. The same reference numerals as in FIG. 11 denote the same parts in FIG. 30, and a detailed description thereof will be omitted.

While the formant emphasis filter having the basic arrangement shown in FIG. 2 is used in the fifth embodiment, the formant emphasis filter having the basic arrangement shown in FIG. 16 is used in the 17th embodiment.

Referring to FIG. 30, a pole-filter-coefficient determination section 81 calculates the product of an LPC coefficient $\lambda_i$ (i=1 to P) and a constant $\lambda^i$ (i: LPC coefficient order) using equation (20) on the basis of the LPC coefficient output from a coefficient transform section 72 to obtain a pole filter coefficient q(i) (i=1 to P). By using equation (23), a zero-filter-coefficient determination section 82 calculates the product of the LPC coefficient $\alpha_i$ (i=1 to P) and a constant t(i) (i=1 to P) stored in a memory table 87 prepared in advance to obtain a pole filter coefficient r(i) (i=1 to P).

A synthesized signal output from a synthesis filter 69 passes through a pitch emphasis filter 53 represented by equation (14), so that the pitch of the synthesized signal is emphasized. In this case, a pitch period L is a pitch period calculated from an adaptive code book index IACB. The pitch filter gain is a predetermined fixed value k (e.g., k=0.7). This embodiment uses the pitch period calculated by the adaptive code book index IACB to perform pitch emphasis, but the pitch period is not limited to this. For example, an output signal from the synthesis filter 69 or an output signal from an adder 68 may be newly analyzed to obtain a pitch period. In addition, the pitch gain need not be limited to the fixed value, and a method of calculating a pitch filter gain from, e.g., the output signal from the synthesis filter 69 or the output signal from the adder 68 may be used.

Formant emphasis is performed through a pole filter 83, a zero filter 84, and an auxiliary filter 88. A fixed characteristic filter represented by equation (9) is used as the auxiliary filter 88. A gain controller controls the output signal power of a formant emphasis filter 13 to be equal to the input signal power in a gain controller 51 and smooths the change in power. The resultant signal is output as a final synthesized speech signal.

The order of the respective filters is not limited to the one described above, but can be arbitrarily determined. In this embodiment, the formant emphasis filter 13 has as its constituent elements the pitch emphasis filter 53 and the auxiliary filter 88. However, the formant emphasis filter 13 may employ an arrangement excluding one or both of the emphasis filter 53 and the auxiliary filter 88. In this embodiment, the pole-filter-coefficient determination section 81 uses the coefficient determination method according to equation (20), and the zero-filter-coefficient determination section 82 uses the coefficient determination method according to equation (23). However, the arrangement is not limited to this. At least one of the pole-filter-coefficient determination section 81 and the zero-filter-coefficient determination section 82 uses the coefficient determination method according to equation (22) or (23).

Figure 31:
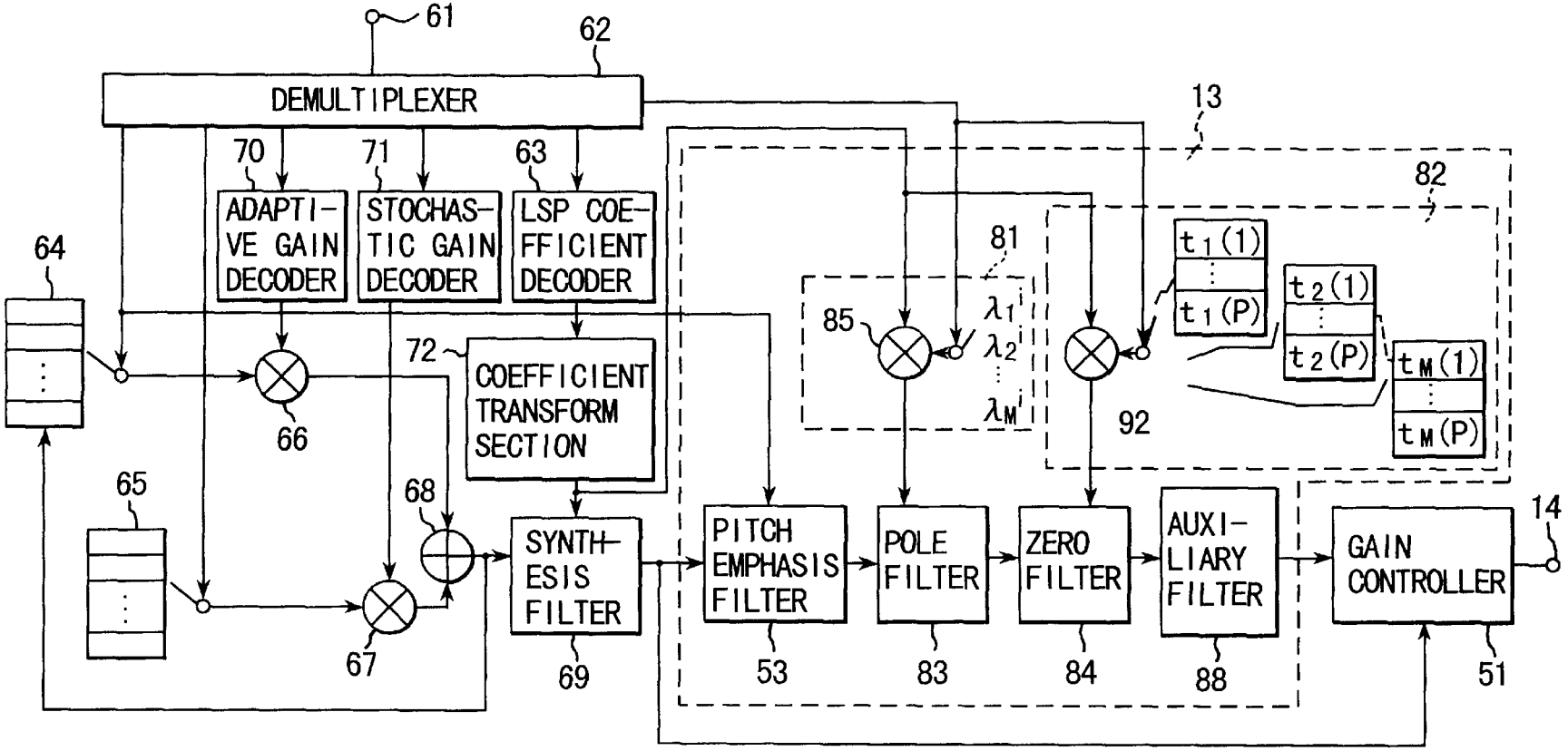
FIG. 31 is a block diagram showing a speech decoding device according to the 18th embodiment.

FIG. 31 shows the speech decoding device of a speech coding/decoding system, to which the present invention is applied, according to the 18th embodiment. The same reference numerals as in FIG. 30 denote the same parts in FIG. 31, and a detailed description thereof will be omitted.

While the fixed value $\lambda$ of the pole-filter-coefficient determination section 81 and the value t(i) (i=1 to P) stored in the memory table 87 for the zero-filter-coefficient determination section 82 are kept unchanged regardless of the attribute of a speech signal input to the formant emphasis filter 13 in the 17th embodiment, one of M constants $\lambda_m$ (m=1 to M) and one of constants $t_m(i)$ (i=1 to P, m=1 to M) stored in memory tables 87, 90 and 91 are selected in accordance with the attribute of an input speech signal to calculate a filter coefficient in the 18th embodiment.

FIG. 31 shows an arrangement in which the attribute of an input speech signal is transmitted as additional information from an encoder (not shown) in selecting the fixed value $\lambda_m$ (m=1 to M) and the constant $t_m(i)$ (i=1 to P, m=1 to M) stored in the memory table 87. Attribute information is decoded by a demultiplexer 62, and the fixed value and the memory table are selected on the basis of the decoded attribute information.

In this embodiment, the attribute information of the input speech signal is transmitted from the encoder. However, an attribute may be determined on the basis of a decoding parameter such as spectrum information obtained from the decoded LPC coefficient, and the magnitude of an adaptive gain, in place of the additional information. In this case, an increase in transmission rate can be prevented because no additional information is required.

Figure 32:
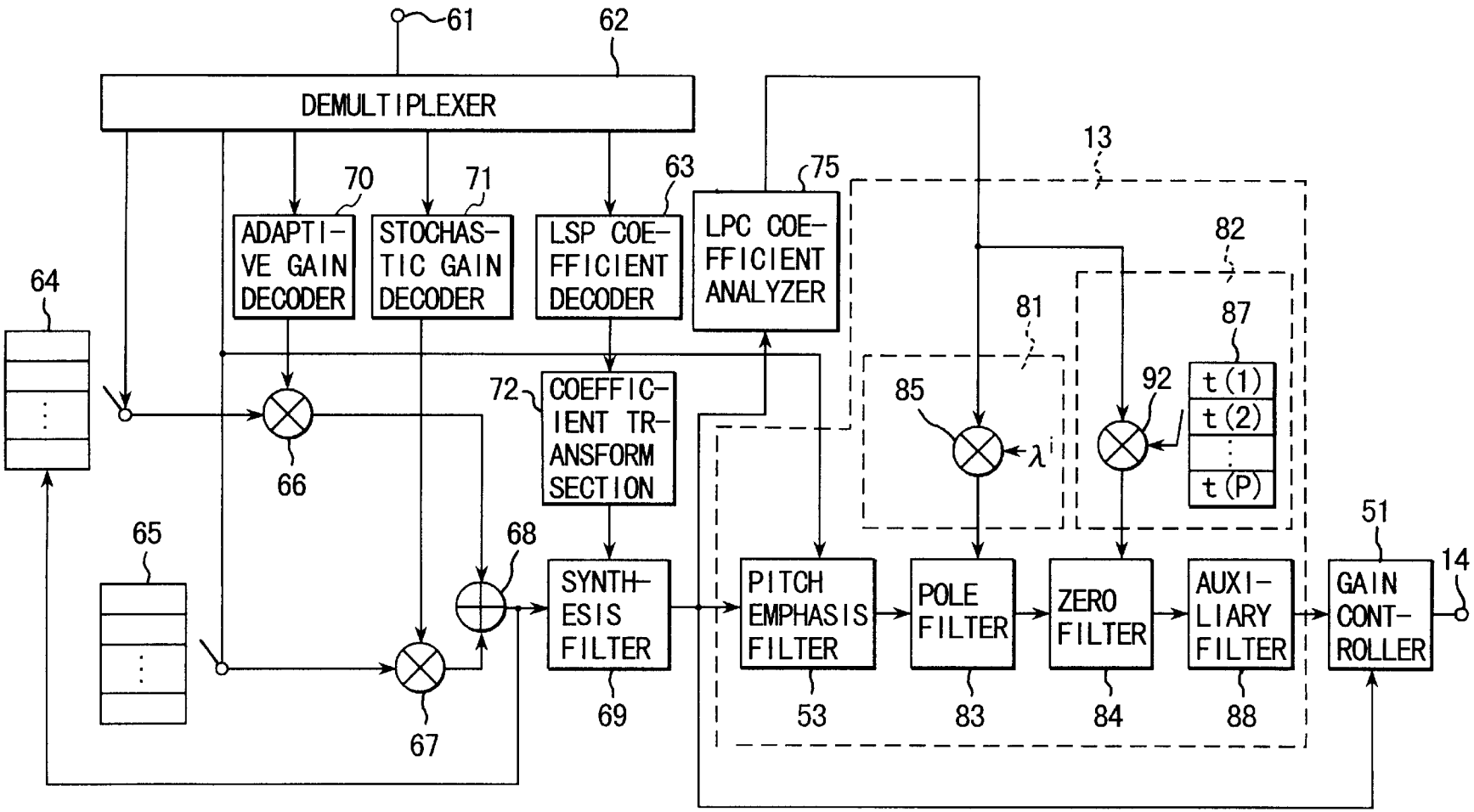
FIG. 32 is a block diagram showing a speech decoding device according to the 19th embodiment.

FIG. 32 shows the speech decoding device of a speech coding/decoding system, to which the present invention is applied, according to the 19th embodiment. The same reference numerals as in FIG. 30 denote the same parts in FIG. 32, and a detailed description thereof will be omitted.

While the pole and zero filter coefficients are calculated on the basis of the decoded LPC coefficient in the 17th embodiment, LPC coefficient analysis of a synthesized signal from a synthesis filter 69 is performed, and pole and zero filter coefficients are calculated on the basis of the resultant LPC coefficient in the 19th embodiment. With this arrangement, formant emphasis can be accurately performed as described with reference to the seventh embodiment. The analysis order of the LPC coefficients can be arbitrarily set. When the analysis order is high, formant emphasis can be finely controlled.

Figure 33:
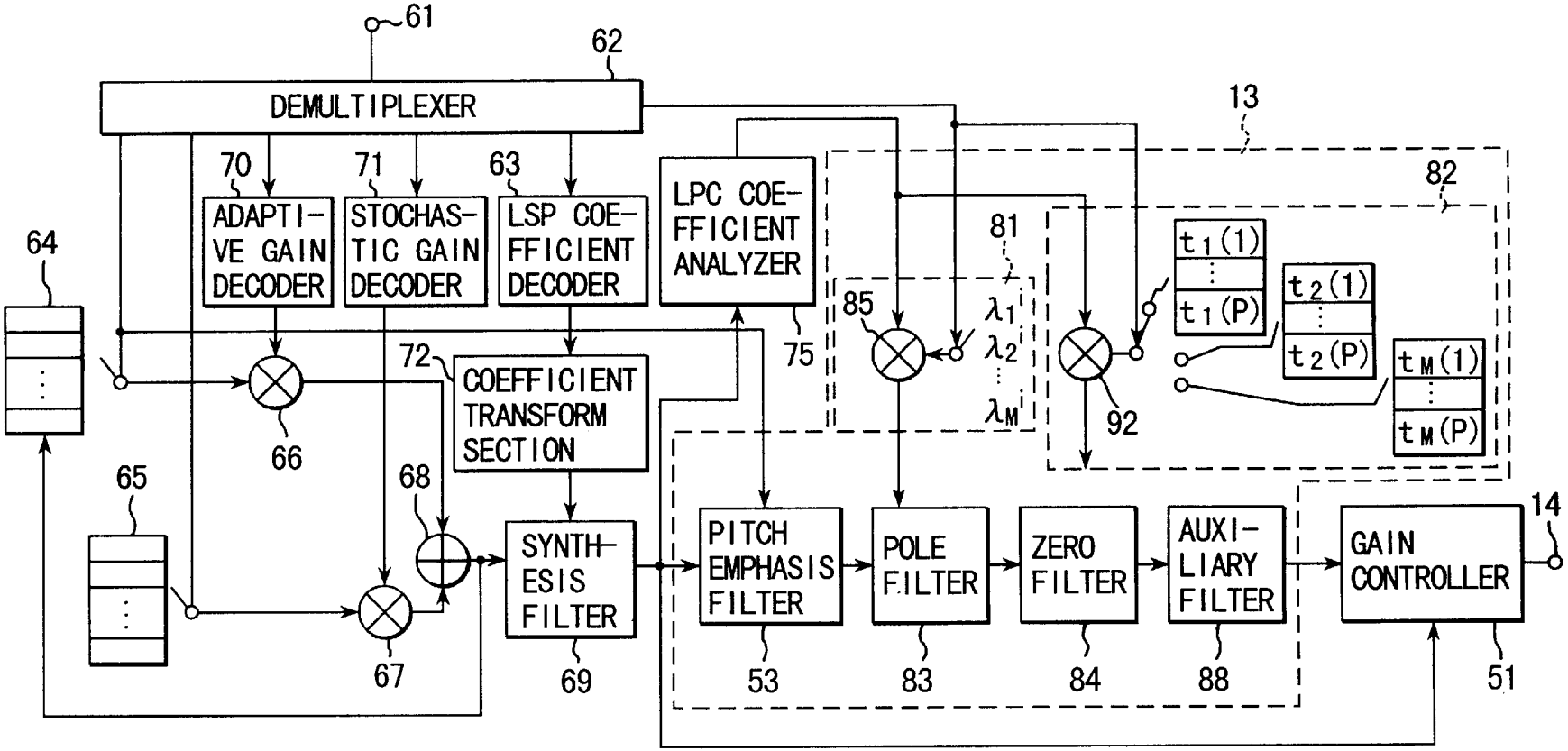
FIG. 33 is a block diagram showing a speech decoding device according to the 20th embodiment.

FIG. 33 shows the speech decoding device of a speech coding/decoding system, to which the present invention is applied, according to the 20th embodiment. The same reference numerals as in FIG. 31 denote the same parts in FIG. 33, and a detailed description thereof will be omitted.

While the pole and zero filter coefficients are calculated on the basis of the decoded LPC coefficient in the 19th embodiment, LPC coefficient analysis of a synthesized signal from a synthesis filter 69 is performed, and pole and zero filter coefficients are calculated on the basis of the resultant LPC coefficient in the 20th embodiment. With this arrangement, formant emphasis can be accurately performed as described with reference to the seventh embodiment. The analysis order of the LPC coefficients can be arbitrarily set. When the analysis order is high, formant emphasis can be finely controlled.

Figure 34:
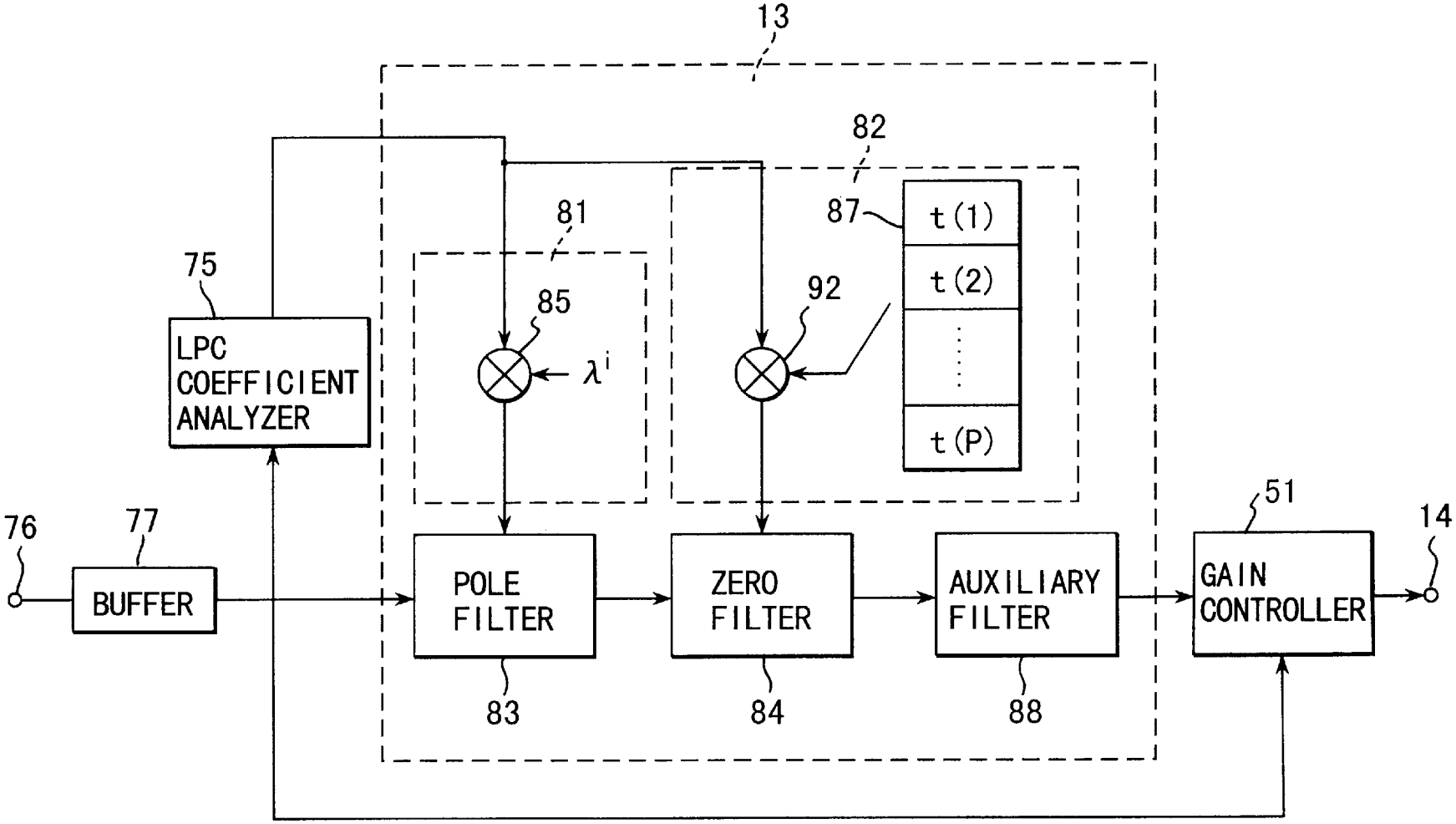
FIG. 34 is a block diagram showing a speech preprocessing device according to the 21st embodiment.

FIG. 34 shows a preprocessor in arbitrary speech processing, to which the present invention is applied, according to the 21st embodiment. The same reference numerals as in FIGS. 15 and 32 denote the same parts in FIG. 34, and a detailed description thereof will be omitted.

While the formant emphasis filter having the basic arrangement shown in FIG. 2 is used in the eighth embodiment, a formant emphasis filter having the basic arrangement shown in FIG. 16 is used in the 21st embodiment.

Figure 35:
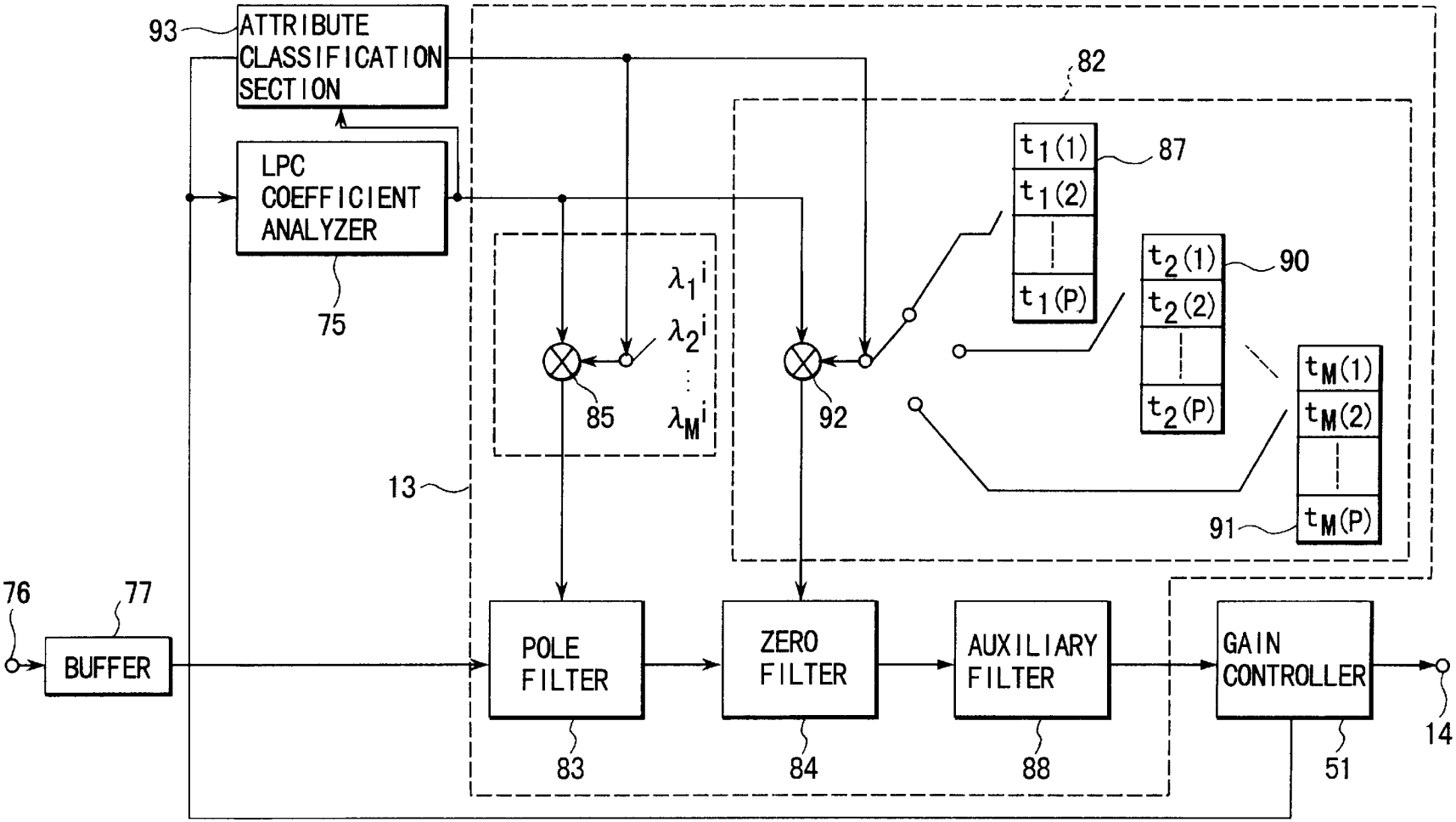
FIG. 35 is a block diagram showing a speech preprocessing device according to the 22nd embodiment.

FIG. 35 shows a preprocessor in arbitrary speech processing, to which the present invention is applied, according to the 22nd embodiment. The same reference numerals as in FIG. 34 denote the same parts in FIG. 35, and a detailed description thereof will be omitted.

While the fixed value $\lambda$ of the pole-filter-coefficient determination section 81 and the constant t(i) (i=1 to P) stored in the memory table 87 for the zero-filter-coefficient determination section 82 are kept unchanged regardless of the attribute of a speech signal input to the formant emphasis filter 13 in the 21st embodiment, one of M constants $\lambda_m$ (m=1 to M) and one of constants $t_m(i)$ (i=1 to P, m=1 to M) stored in memory tables 87, 90 and 91 are selected in accordance with the attribute of an input speech signal to calculate a filter coefficient in the 22nd embodiment.

FIG. 35 shows analysis of the attribute of an input speech signal in an attribute classification section 93 using the input speech signal stored in a buffer 77 and LPC coefficients $\alpha_i$ (i=1 to P) output from an LPC coefficient analyzer 75 in selecting fixed values $\lambda_m$ (m=1 to M) and constants $t_m(i)$ (i=1 to P, m=1 to M) stored in memory tables 87, 90, and 91. Constants used for a given frame are selected from the M constants $\lambda_m$ (m=1 to M) and the constants $t_m(i)$ (i=1 to P, m=1 to M) on the basis of the analysis result and uses them for calculating filter coefficients. The attribute classification section 93 determines an attribute using spectrum information and pitch information of the input speech signal.

A speech decoding device using a formant emphasis filter and a pitch emphasis filter according to the 23rd embodiment will be described with reference to FIG. 36.

Figure 36:
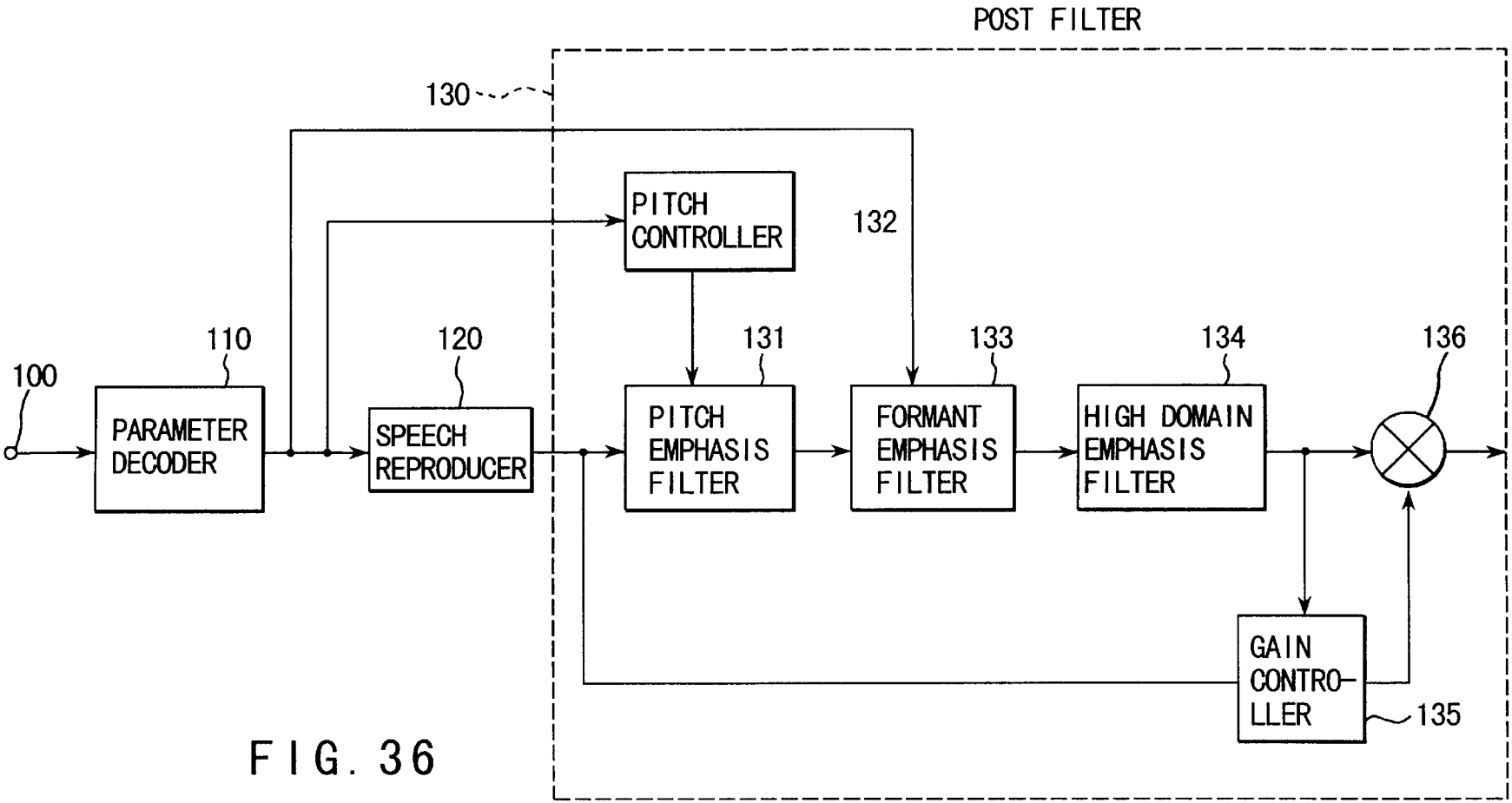
FIG. 36 is a block diagram showing a speech decoding device according to the 23rd embodiment.

Referring to FIG. 36, a portion surrounded by a dotted line represents a post filter 130 which constitutes the speech decoding device together with a parameter decoder 110 and a speech reproducer 120. Coded data transmitted from a speech coding device (not shown) is input to an input terminal 100 and sent to the parameter decoder 110. The parameter decoder 110 decodes a parameter used for the speech reproducer 120. The speech reproducer 120 reproduces the speech signal using the input parameter. The parameter decoder 110 and the speech reproducer 120 can be variably arranged depending on the arrangement of the coding device. The post filter 130 is not limited to the arrangement of the parameter decoder 110 and the speech reproducer 120, but can be applied to a variety of speech decoding devices. A detailed description of the parameter decoder 110 and the speech reproducer 120 will be omitted.

The post filter 130 comprises a pitch emphasis filter 131, a pitch controller 132, a formant emphasis filter 133, a high frequency domain emphasis filter 134, a gain controller 135, and a multiplier 136.

Figure 37:
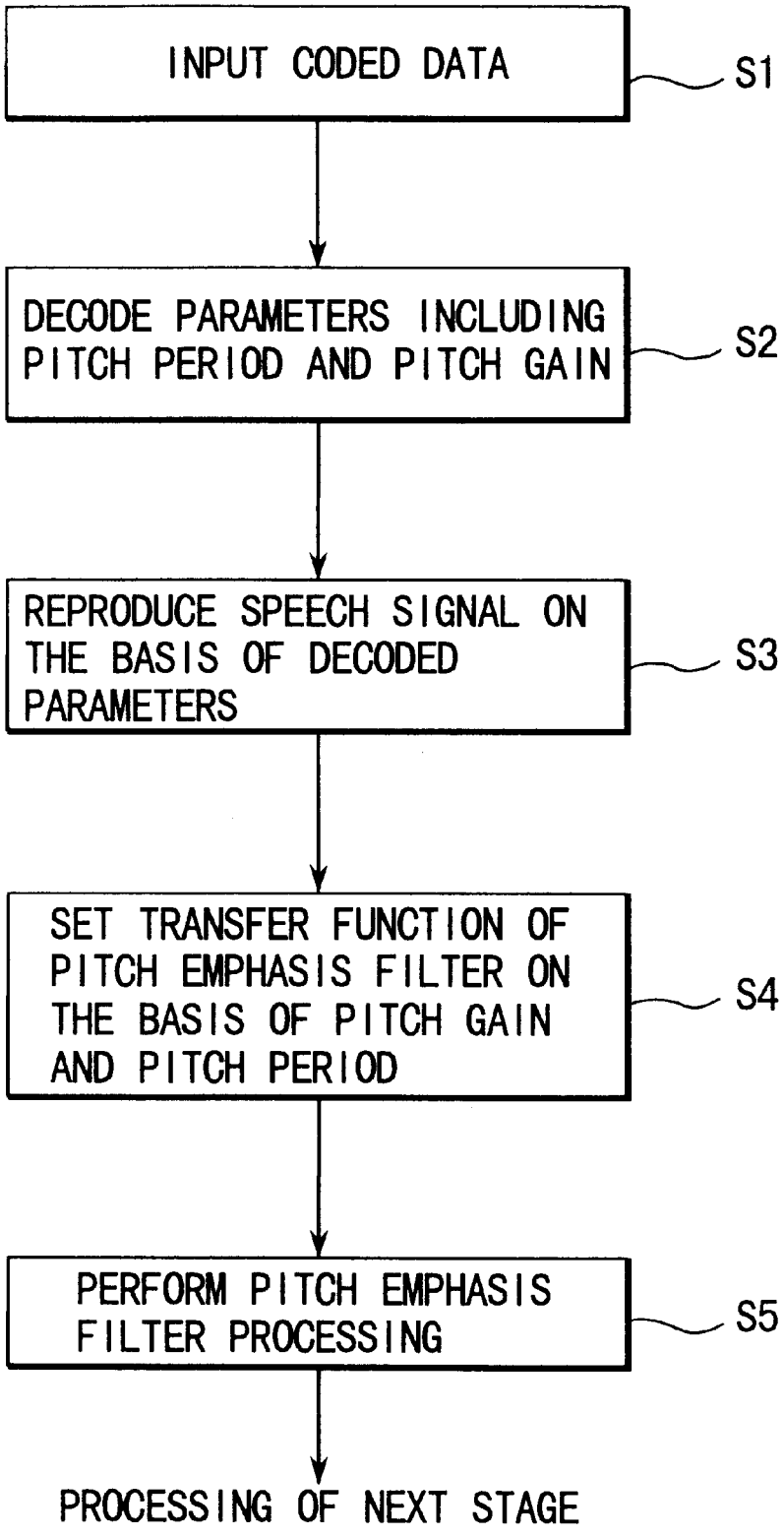
FIG. 37 is a flow chart schematically showing main processing of the 23rd embodiment.

A schematic sequence of main processing of the decoding device in FIG. 36 will be described with reference to FIG. 37. When coded data is input to the input terminal 100 (step S1), the parameter decoder 110 decodes parameters such as a frame gain, a pitch period, a pitch gain, a stochastic vector, and an excitation gain (step S2). The speech reproducer 120 reproduces the original speech signal on the basis of these parameters (step S3).

Of all the parameters decoded by the parameter decoder 110, the pitch period and gain as the pitch parameters are used to set a transfer function of the pitch emphasis filter 131 under the control of the pitch controller 132 (step S4). The reproduced speech signal is subjected to pitch emphasis processing by the pitch emphasis filter 131 (step S5). The pitch controller 132 controls the transfer function of the pitch emphasis filter 131 to change the degree of pitch emphasis on the basis of a time change in pitch period (to be described later), and more specifically, to lower the degree of pitch emphasis when a time change in pitch period is larger.

The speech signal whose pitch is emphasized by the pitch emphasis filter 131 is further processed by the formant emphasis filter 133, the high frequency domain emphasis filter 134, the gain controller 135, and the multiplier 136. The formant emphasis filter 133 emphasizes the peak (formant) of the speech signal and attenuates the valley thereof, as described in each previous embodiment. The high frequency domain emphasis filter 134 emphasizes the high-frequency component to improve the muffled speech which is caused by the formant emphasis filter. The gain controller 135 corrects the gain of the entire post filter through the multiplier 135 so as not to change the signal powers between the input and output of the post filter 130. The high frequency domain emphasis filter 134 and the gain controller 135 can be arranged using various known techniques as in the formant emphasis filter 133.

Figure 38:
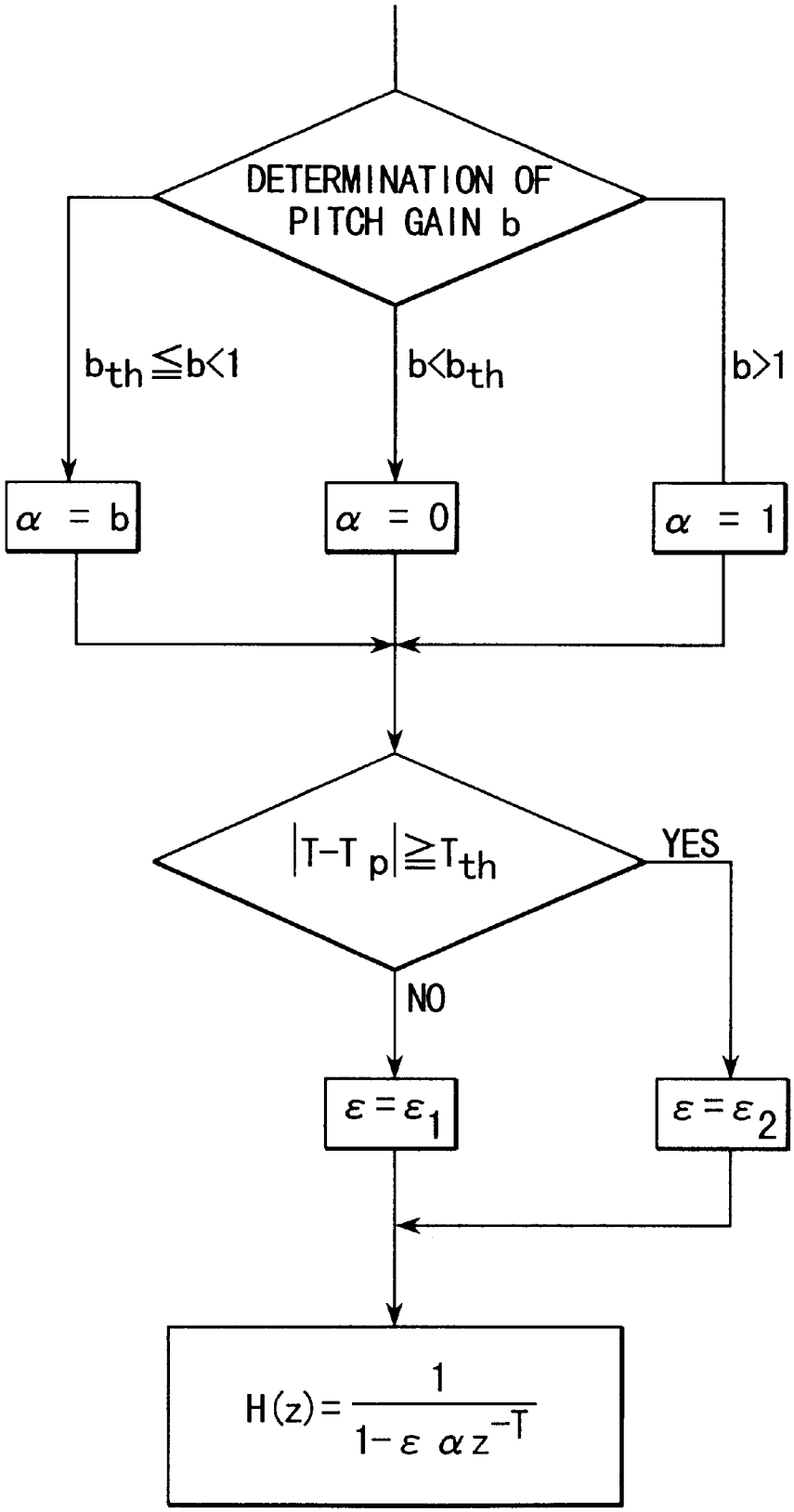
FIG. 38 is a flow chart showing a transfer function setting sequence of a pitch emphasis filter according to the 23rd embodiment.

When an all-pole pitch emphasis filter is used as the pitch emphasis filter 131, the pitch emphasis filter 131 can be defined by a transfer function H(z) represented by equation (26):

$$H(z)=1/(1-\epsilon\alpha z^{-T}) \tag{26}$$

where T is the pitch period, $\epsilon$ and $\alpha$ are filter coefficients determined by the pitch controller 132. In this case, the transfer function of the pitch emphasis filter 131 is set in accordance with a sequence shown in FIG. 38. That is, a pitch gain b is determined on the basis of the pitch controller 135 or equation (27), a filter coefficient $\alpha$ is calculated on the basis of this determination result, a time change in pitch period T is determined, and a filter coefficient $\epsilon$ is determined by equation (28) using this determination result:

$$\alpha = \begin{cases} b & (b_{th} \leqq b < 1) \\ 0 & (b < b_{th}) \\ 1 & (b > 1) \end{cases} \tag{27}$$

$$\varepsilon = \begin{cases} \varepsilon_1 & (|T - T_p| < T_{th}) \\ \varepsilon_2 & (|T - T_p| \geqq T_{th}) \end{cases} \tag{28}$$

where b is the decoded pitch gain, $b_{th}$ is a voice/unvoice determination threshold, $\epsilon_1$ and $\epsilon_2$ are parameters for controlling the degree of pitch emphasis, $T_p$ is the pitch period of the previous frame, and $T_{th}$ is the threshold for determining a time change $|T-Tp|$ in pitch period T. Typically, threshold bth is 0.6, the parameter $\epsilon_1$ is 0.8, the parameter $\epsilon_2$ is 0.4 or 0.0, and the threshold Tth is 10. As described above, the filter coefficients $\epsilon$ and $\alpha$ are determined, and the transfer function H(z) represented by equation (26) is set. On the other hand, the pitch emphasis filter 131 is defined by a zero-pole transfer function represented by equation (29):

$$H(z) = Cg1 + \frac{\gamma z^{-T}}{1 - \lambda z^{-T}} \tag{29}$$

Figure 39:
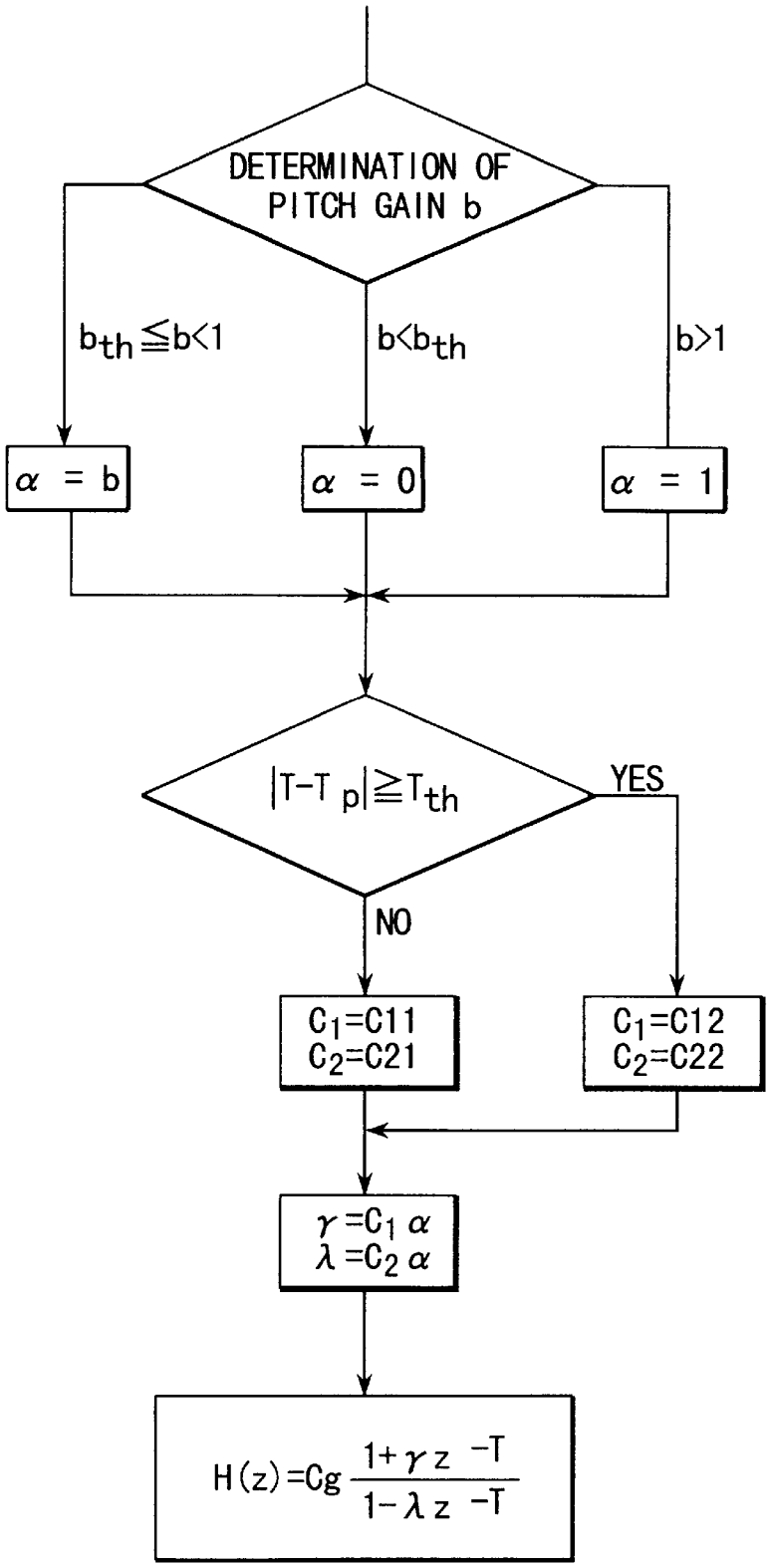
FIG. 39 is a flow chart showing another transfer function setting sequence of the pitch emphasis filter according to the 23rd embodiment.

In this case, the pitch controller 132 sets the transfer function of the pitch emphasis filter 131 in accordance with a sequence shown in FIG. 39. That is, a pitch gain b is determined as in the pitch controller 135 or equation (30), a parameter a is calculated on the basis of the determination result, $\alpha$ time change in pitch period T is determined, and parameters C1 and C2 are calculated by equations (31) and (32) using this determination result:

$$\alpha = \begin{cases} b & (b_{th} \leqq b < 1) \\ 0 & (b < b_{th}) \\ 1 & (b > 1) \end{cases} \quad (30)$$

$$C_1 = \begin{cases} c11 & (|T - T_p| < T_{th}) \\ c12 & (|T - T_p| \geqq T_{th}) \end{cases} \quad (31)$$

$$C_2 = \begin{cases} c21 & (|T - T_p| < T_{th}) \\ c22 & (|T - T_p| \geqq T_{th}) \end{cases} \quad (32)$$

On the basis of these parameters $\alpha$, $C_1$, and $C_2$, filter coefficients $\gamma$ and $\lambda$ of the pitch emphasis filter 131 are calculated using equations (33) and (34):

$$\gamma = C_1\alpha \quad (33)$$

$$\lambda = C_2\alpha \quad (34)$$

characterized in that c11, c12, c21, and c22 are empirically determined under the following limitations:

$$0 < c11,\ c12,\ c21,\ c22 < 1 \quad (35)$$

$$c11 > c12 \quad (36)$$

$$c21 > c22 \quad (37)$$

Typically, c11=0.4, c12=0.0, c21=0.8, and c22=0.0.

Cg is a parameter for absorbing gain variations of the pitch emphasis filter 131 which are generated depending on the difference between voice and unvoice and can be calculated by equation (38):

$$Cg = (1 - \lambda/b)/(1 + \gamma/b) \quad (38)$$

As can be apparent from the above description, in any arrangement of the pitch emphasis filter 131, the filter coefficients are controlled by the pitch controller 132 such that a degree of pitch emphasis with respect to the input speech signal is lowered when the time change |T−Tp| in pitch period T is equal to or larger than the threshold Tth.

In the above description, when the change |T−Tp| is equal to or larger than the threshold $T_{th}$, pitch emphasis is performed at a small degree of emphasis. However, an arrangement which does not perform pitch emphasis process itself may be obtained.

In the above description, when the time change in pitch period is equal to or larger than the threshold, the degree of pitch emphasis is lowered. However, when the time change in period of the pitch gain is equal to or larger than the threshold, the degree of pitch emphasis may be lowered to obtain the same effect as described above.

Figure 40:
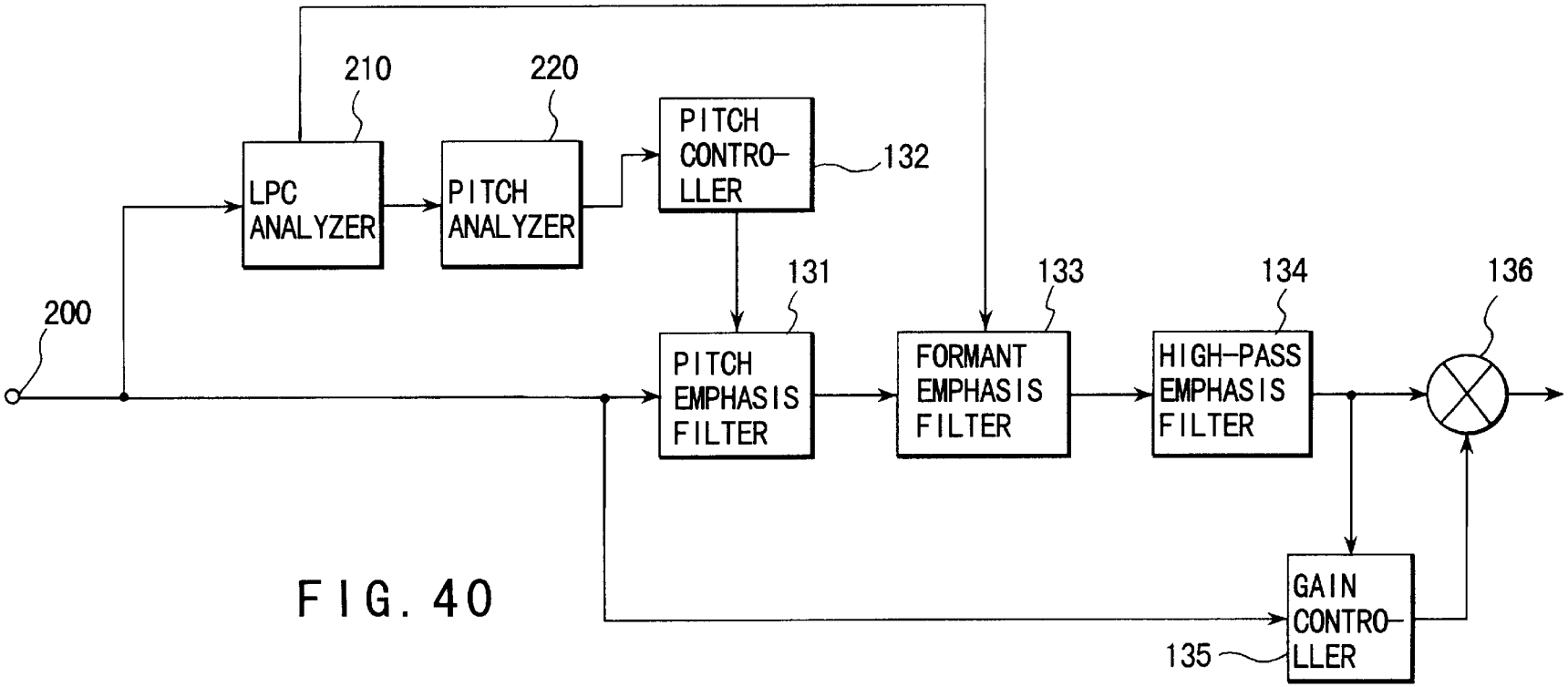
FIG. 40 is a block diagram showing the arrangement of an enhance processing device according to the 24th embodiment.

The above embodiment has exemplified the speech decoding device to which the present invention is applied. However, the present invention is also applicable to a technique called enhance processing applied to a speech signal including various noise components so as to improve subjective quality. This embodiment is shown in FIG. 40.

The same reference numerals as in FIG. 35 denote the same parts in FIG. 40, and only differences will be described below. In the 24th embodiment shown in FIG. 40, a speech signal is input to an input terminal 200. This input speech signal is, for example, a speech signal reproduced by the speech reproducer 120 in FIG. 36 or a speech signal synthesized by a speech synthesis device. The input speech signal is subjected to enhance processing through a pitch emphasis filter 131, a formant emphasis filter 133, a high frequency domain emphasis filter 134, a gain controller 135, and a multiplier 136 as in the above embodiment.

In this embodiment, an input signal is a speech signal and, unlike the embodiment shown in FIG. 36, does not include parameters such as a pitch gain. The input speech signal is supplied to an LPC analyzer 210 and a pitch analyzer 220 to generate pitch period information and pitch gain information which are required to cause a pitch controller 132 to set the transfer function of the pitch emphasis filter 131. The remaining part of this embodiment is the same as that of the previous embodiment, and a detailed description thereof will be omitted.

The present invention is not limited to speech signals representing voices uttered by persons, but is also applicable to a variety of audio signals such as musical signals. The speech signals of the present invention include all these signals.

As described above, according to the present invention, there is provided a formant emphasis method capable of obtaining high-quality speech.

More specifically, formant emphasis processing for emphasizing the spectral formant of an input speech signal and attenuating the spectral valley is performed. At the same time, a spectral tilt caused by this formant emphasis processing is compensated by a first-order filter whose characteristics adaptively change in accordance with the characteristics of the input speech signal or the spectrum emphasis characteristics, and a first-order filter whose characteristics are fixed. Therefore, formant emphasis of the speech signal and compensation of the excessive spectral tilt caused by the formant emphasis can be effectively performed in a small processing quantity, thereby greatly improving the subjective quality.

A pole filter performs formant emphasis processing for emphasizing the spectral formant of an input speech signal and attenuating the valley of the input speech signal, and a zero filter is used to compensate the spectral tilt caused by this formant emphasis processing. At the same time, at least one of the filter coefficients of the pole and zero filters is determined by the product of each coefficient of each order of LPC coefficients of the input speech signal and a constant arbitrarily predetermined in correspondence with each coefficient of each order of the LPC coefficients. The filter coefficients of the formant emphasis filter can be finely controlled, and therefore high-quality speech can be obtained.

According to the present invention, a change in pitch period is monitored. When this change is equal to or larger than a predetermined value, the degree of pitch emphasis is lowered, i.e., the coefficient of the pitch emphasis filter is changed to lower the degree of emphasis. In some cases, emphasis itself is interrupted to suppress the disturbance of harmonics. The quality of a reproduced speech signal or a synthesized speech signal can be effectively improved.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A speech decoding device comprising:

a parameter decoding device which decodes a parameter including at least one of a pitch period and a pitch gain of a speech signal from coded speech signal data;

a synthesis filter which filters the speech signal using the parameter decoded by said parameter decoding device;

a pitch emphasis device which pitch-emphasizes the speech signal filtered by said synthesis filter; and a control device which detects a time change in at least one of the pitch period and the pitch gain decoded by said parameter decoding device, and controls a degree of pitch emphasis in said pitch emphasis device on the basis of the change.

2. A speech decoding device comprising:

a parameter decoding device which decodes parameters including at least one of a pitch period of a speech signal and a pitch gain thereof from encoded data of the speech signal;

a synthesis filter which filters the speech signal by use of the parameters decoded by said parameter decoding device;

a main filter which performs a format emphasis processing for emphasizing a formant of spectrum of the speech signal filtered by said synthesis filter on the basis of a LPC coefficient representing a spectrum envelop of the speech signal and attenuating a valley thereof; and first and second primary-order filters cascade connected to compensate a spectral tilt, caused by the formant emphasis processing, said first primary-order filter having characteristics adaptively change in accordance with characteristics of the input speech signal or spectrum emphasis characteristics and said second primary-order filter having fixed characteristics.

3. The speech decoding device according to claim 2, further comprising a filter coefficient determination section which determines a filter coefficient on the basis of a LPC coefficient of the input speech signal and inputting the determined filter coefficient to said first primary-order filter.

4. The speech decoding device according to claim 3, wherein said filter coefficient determination section comprises:

a coefficient converter which converts the LPC coefficient of the input speech signal to a PARCOR coefficient; and a multiplier which multiplies the PARCOR coefficient by a positive constant to obtain a filter coefficient.

5. The speech decoding device according to claim 4, wherein said input speech signal is input in units of frames further comprising:

a buffer memory which stores a filter coefficient relating to a previous frame of the input speech signal; and a filter coefficient limiter which limits variation of the filter coefficient relating to a current frame which is calculated by said multiplier on the basis of the filter coefficient relating to the previous frame.

6. The speech decoding device according to claim 1, further comprising:

a filter coefficient determination section which determines a filter coefficient on the basis of a weighted LPC coefficient used by said main filter and inputs the determined filter coefficient to said first primary-order filter.

7. The speech decoding device according to claim 6, wherein said filter coefficient determination section comprises:

a coefficient converter which converts the weighted LPC coefficient to a PARCOR coefficient; and a multiplier which multiplies the PARCOR coefficient by a positive constant to obtain a filter coefficient.

8. The speech decoding device according to claim 7, wherein said input speech signal is input in units of frames further comprising:

a buffer memory which stores a filter coefficient relating to a previous frame of the input speech signal; and a filter coefficient limiter which limits variation of the filter coefficient relating to a current frame which is calculated by said multiplier on the basis of the filter coefficient relating to the previous frame.

9. A speech decoding device comprising:

a parameter decoding device which decodes parameters including at least one of a pitch period and a pitch gain of a speech signal from encoded data of the speech signal;

a synthesis filter which filters the speech signal by use of the parameters decoded by said parameter decoding device;

a main filter which performs a formant emphasis processing for emphasizing a formant of spectrum of the speech signal filtered by said synthesis filter on the basis of a LPC coefficient representing a spectrum envelop of the speech signal and attenuating a valley thereof;

first and second primary-order filters cascade-connected to compensate a spectral tilt, caused by the formant emphasis processing, said first primary-order filter having characteristics adaptively change in accordance with characteristics of the input speech signal or spectrum emphasis characteristics and said second primary-order filter having fixed characteristics; and an adjusting device which subjects at least one of a gain adjusting and a pitch adjusting to an output signal of said formant emphasis filter.

10. The speech decoding device according to claim 1, wherein said adjusting device comprises:

a gain controller which adjusts a gain of the output signal of said formant emphasis filter in accordance with the characteristics of the input speech signal.

11. The speech decoding device according to claim 9, wherein said adjusting device comprises:

a pitch emphasis filter which pitch-emphasizes the output signal of said formant emphasis filter; and a gain controller which adjusts a gain of an output signal of said pitch emphasis filter in accordance with the characteristics of the input speech signal.

12. A speech decoding device comprising:

a parameter decoding device which decodes parameters including at least on of a pitch period of a speech signal and a pitch gain thereof from encoded data of the speech signal;

a synthesis filter which filters the speech signal by use of the parameters decoded by said parameter decoding device;

a filter circuit including a pole filter which performs a formant emphasis processing for emphasizing a formant of spectrum of the speech signal filtered by said synthesis filter on the basis of a LPC coefficient representing a spectrum envelop of the speech signal and attenuating a valley thereof, and a zero filter for compensating a spectral tilt, caused by the formant emphasis processing of said pole filter, wherein said pole filter and said zero filter are cascade-connected; and a filter coefficient determination section which determines filter coefficients of said pole filter and said zero filter in accordance with the input speech signal.

13. The speech decoding device according to claim 11, wherein said filter coefficient determination section comprises:

a multiplier which multiplies coefficients of each order of LPC coefficients of the input speech signal by respective constants $\lambda^i$ (i: the orders of LPC coefficients) to obtain a filter coefficient.

14. The speech decoding device according to claim 13, wherein said filter coefficient determination section comprises:

a constant storage in which a plurality of coefficients previously determined in correspondence with the coefficients of each order of the LPC coefficients of the input speech signal are stored; and a multiplier which multiplies the coefficients of each order of the LPC coefficients by corresponding constants stored in said storage to determine at least one of the filter coefficient of the pole filter and the filter coefficient of the zero filter.

15. The speech decoding device according to claim 14, wherein said constant storage comprises:

a memory table which stores constants determined for obtaining filter coefficients by which a sound quality satisfying a user's liking is obtained.

16. The speech decoding device according to claim 14, wherein said constant storage comprises a plurality of memory tables which store respective kinds of constants, and said filter coefficient determination section has a selector which selects one of said memory tables in accordance with input attribute information.

17. The speech decoding device according to claim 14, wherein said filter circuit has at least one of a subsidiary filter which subsidizes a correction of a spectral tilt caused by said zero filter and a pitch emphasis filter which pitch-emphasizes the input speech signal in accordance with a pitch period and a filter gain and outputs a pitch emphasized speech signal to said filter circuit.

18. The speech decoding device according to claim 17, wherein said constant storage includes a plurality of memory tables for storing respective kinds of constants, and said filter coefficient determination section includes a table selector which selects one of said memory tables in accordance with input attribute information.

* * * * *